US007769337B2

(12) United States Patent
Itoh et al.

(10) Patent No.: US 7,769,337 B2
(45) Date of Patent: Aug. 3, 2010

(54) IMAGE FORMING METHOD

(75) Inventors: Muneharu Itoh, Tokyo (JP); Hiroto Kidokoro, Tokyo (JP)

(73) Assignee: Zeon Corporation, Tokyo (JP)

( * ) Notice: Subject to any disclaimer, the term of this patent is extended or adjusted under 35 U.S.C. 154(b) by 355 days.

(21) Appl. No.: 12/065,410

(22) PCT Filed: Aug. 30, 2006

(86) PCT No.: PCT/JP2006/317097

§ 371 (c)(1),
(2), (4) Date: Feb. 29, 2008

(87) PCT Pub. No.: WO2007/026758

PCT Pub. Date: Mar. 8, 2007

(65) Prior Publication Data

US 2009/0154971 A1 Jun. 18, 2009

(30) Foreign Application Priority Data

Aug. 31, 2005 (JP) ..... 2005-252062
Sep. 29, 2005 (JP) ..... 2005-285577

(51) Int. Cl.
*G03G 21/00* (2006.01)

(52) U.S. Cl. ..... 399/350

(58) Field of Classification Search ..... 399/350, 399/351

See application file for complete search history.

(56) References Cited

U.S. PATENT DOCUMENTS

2006/0210908 A1* 9/2006 Umemura et al. ..... 430/125

FOREIGN PATENT DOCUMENTS

JP 8-248851 A 9/1996

JP 2001-343874 A 12/2001

(Continued)

OTHER PUBLICATIONS

International Search Report dated Oct. 2, 2006 issued in corresponding PCT Application No. PCT/JP2006/317097.

*Primary Examiner*—Quana M Grainger
(74) *Attorney, Agent, or Firm*—Westerman, Hattori, Daniels & Adrian, LLP

(57) ABSTRACT

An image forming method using a cleaning blade which prevents the spherical toner to pass through a gap between the blade and a photosensitive member and which has durability so as to be less worn away or chipped, wherein it is possible to maintain cleaning performance over a long term even in high-speed printing using spherical toner, and a non-transferred toner and external additives dropping out from colored particles less causes filming on the photosensitive member and less gives damage to the surface of the photosensitive member, is provided.

A method of forming an image using a toner having an average circularity of 0.95 to 0.998 to perform developing, transferring, fixing and cleaning for removing the toner remaining on the photosensitive member after the transferring by a cleaning blade 6 abutting on the photosensitive member, wherein an abutting portion of the cleaning blade 6 on the photosensitive member has an indentation modulus (A) of 5 to 15 KPa at an indenting load of 10 mN and 23° C., a ratio of the modulus (A) to an indentation modulus (B) at an indenting load of 100 mN and 23° C. of 1.1 to 1.8, and a loss tangent (tan δ) of the cleaning blade at 20 to 50° C. in the range from 0.01 to 0.1.

9 Claims, 3 Drawing Sheets

FOREIGN PATENT DOCUMENTS

| | | | |
|---|---|---|---|
| JP | 2003-103686 | A | 4/2003 |
| JP | 2004-233818 | A | 8/2004 |
| JP | 2005-148403 | A | 6/2005 |
| JP | 2005-156696 | A | 6/2005 |
| JP | 2005-181434 | A | 7/2005 |
| JP | 2005-181782 | A | 7/2005 |

* cited by examiner h1: depth when desired load is applied
h2: state that h1 load is maintained
h1': state that load is removed from the state h2
Dash line: tangent line to obtain Eit

IMAGE FORMING METHOD

TECHNICAL FIELD

The present invention relates to an image forming method of forming a latent image having electrostatic property such as an electrostatic latent image on a photosensitive member, developing the image with a toner for developing electrostatic latent image, and then transferring the resultant visible image onto a recording material. Particularly, the present invention relates to an image forming method having a process of removing a toner for developing electrostatic latent image remaining on a photosensitive member after a transferring process by a cleaning blade.

BACKGROUND ART

In electrophotography, an electrostatic latent image formed on a photosensitive member is developed by a toner for developing electrostatic latent image (hereinafter, it may be simply referred to as a toner) wherein external additives are blended with colored particles, and the resultant visible image is transferred onto a recording material such as a piece of paper or an OHP sheet. Thereafter, the transferred visible image is fixed to yield a printed matter.

In the formation of a color image by full color electrophotography, color toners in three colors of yellow, magenta and cyan or in four colors of the three colors plus black are used to reproduce colors. In an example of a case of color copying, a colored original is first decomposed into many pixels so as to be read out. In color print, digital image signals separated in accordance with individual colors are transmitted from a computer or the like to a light radiating device, and then light is radiated onto a charged photosensitive member from the light radiating device to form an electrostatic latent image. Next, the electrostatic latent image on the photosensitive member is developed by action of a color toner corresponding to first-color-signals out of the image signals of the electrostatic latent image, which are separated from each other in accordance with the individual colors, and then this is transferred onto a recording material such as a piece of paper or an OHP sheet.

This developing and transferring process is successively repeated for each of the colors from the second color to the last color. While their registrations are made consistent with each other, the toner images in the individual colors are laid onto the recording material. The laid toner images are fixed, thereby forming a full color image.

In the transferring process, the toner which remains on the photosensitive member without being transferred (hereinafter, it may be referred to as the "non-transferred toner") is removed by a cleaning device.

For the cleaning device, there have been conventionally known various cleaning manners using a cleaning blade, a fur brush roller, a cleaning roller having abrading ability and so on. Particularly, the manner using a cleaning blade gives a simple structure. Thus, the manner is widely used.

In the meantime, conventionally, a toner produced by the pulverization process (the so-called pulverization process toner) has widely been used as toner used in development. However, about the pulverization process toner, the shape of the toner particles is variable, and the particle diameter distribution thereof is difficult to control. These matters have hindered an improvement in image quality. To the contrary, in recent years, there have been used toners wherein the shape of colored particles and the particle diameter distribution thereof are highly controlled such as a toner produced by the polymerization process (the so-called polymerization process toner) in order to improve the reproducibility of images or image qualities such as minuteness or the like.

The polymerization process is a process of making a polymerizable monomer composition containing a polymerizable monomer and a colorant into an aqueous dispersion medium, so as to form droplets, and then polymerizing the droplets to produce colored particles. The polymerization process toner is the so-called spherical toner, wherein the shape of colored particles is closer to a sphere than that in the pulverization process toner, and can be rendered a toner having a small particle diameter and a sharp particle diameter distribution.

However, when the spherical toner is used, the non-transferred toner thereof passes easily through a gap between the photosensitive member and the cleaning blade in a cleaning process. In other words, a poor cleaning is easily caused, thus, by repeating the formation of images, the non-transferred toner causes filming on the photosensitive member or the following causes: an insufficient electrification of the surface of the photosensitive member, a poor formation of electrostatic latent images, a decline in the charge amount of the toner, the generation of fogging or the like.

The poor cleaning is more easily caused by abrasion or chipping of a tip of the cleaning blade (at its portion abutting on the photosensitive member), a rise in printing speed (the rotating speed of the photosensitive member), or downsizing of the toner for making images more minute.

In the cleaning process by a cleaning blade, external additives drops out from a toner and the external additives accumulate on the photosensitive member so as to cause filming thereon, and injure the surface of the photosensitive member. It is presumed that these phenomena are caused by physical properties of the cleaning blade such as the viscoelasticity, hardness thereof or the like. The phenomena are particularly remarkably caused in the case of high-speed printing.

Japanese Patent Application Laid-Open (JP-A) No. 2001-343874 discloses a cleaning blade made mainly of a polyurethane resin, wherein a cured layer that is obtained by causing an isocyanate compound and the polyurethane resin to react with each other and that has a thickness of 0.12 mm or more and 1.2 mm or less is formed only at a portion abutting on a toner carrying member (claim 1 in JP-A No. 2001-343874).

JP-A No. 2001-343874 mentions that the cleaning blade makes it possible to form its portion abutting on the toner carrying member (photosensitive member) so as to have a low frictional coefficient and a high hardness while the mobility of its free-length portion (the mobility in the longitudinal direction) is kept, thereby realizing good cleaning performance and durability.

JP-A No. 2003-103686 discloses a blade for an electrophotographic machine having, as its substrate, an elastomer comprising a polyurethane having a Shore A hardness of 60 to 80 at 23° C. having a layer having a thickness of 0.5 to 5 μm and comprising flexible diamond-like carbon (FDLC) in at least a portion abutting on a partner member (photosensitive member), and having a specific statically frictional coefficient (claims 1, 2 and 4 in JP-A No. 2003-103686).

JP-A No. 2003-103686 mentions that the electrophotographic machine blade is an electrophotographic machine blade wherein only the surface frictional coefficient thereof is lowered without damaging basic properties of an elastomer as a substrate.

JP-A No. 2005-181782 describes a cleaning blade comprising an elastomer having an elastic displacement ratio of 50% or more, the ratio being the ratio of the elastic displacement, which represents the difference between the maximum displacement and the plastic displacement, to the maximum displacement.

However, these cleaning blades are not sufficient in the performance of cleaning spherical toner.

DISCLOSURE OF THE PRESENT INVENTION

Problems to be Solved by the Present Invention

An object of the present invention is to provide an image forming method which makes it possible to maintain cleaning performance over a long term even in high-speed printing using spherical toner using a cleaning blade which prevents the spherical toner to pass through a gap between the cleaning blade and a photosensitive member and which has durability so as to be less worn away or chipped, and is capable of preventing non-transferred toner and external additives dropping out from colored particles to cause filming on the photosensitive member and damages to the surface of the photosensitive member.

Means for Solving the Problems

In order to attain the object, the inventors have newly paid attention to physical properties of the vicinity of an abutting portion of a cleaning blade on a photosensitive member, and made eager investigations so as to obtain the following finding: the object can be attained in the case that: about the elastic modulus of the vicinity of the abutting portion of the cleaning blade on the photosensitive member in the depth direction, a given relationship is satisfied between the indentation modulus at an indenting load of 10 mN and that at an indenting load of 100 mN, which respectively correspond to the modulus of a depth region from 15 to 25 μm apart from the blade surface and that of a depth region from 50 to 100 μm apart therefrom, in the abutting portion of the cleaning blade on the photosensitive member, and further the loss tangent of the cleaning blade at 20 to 50° C. is in a given range.

Additionally, the inventors have obtained a finding that more preferable results are obtained in the case that: about the hardness of the abutting portion of the cleaning blade on the photosensitive member in the depth direction, a given relationship is satisfied between the Martens hardness at an indenting load of 10 mN and that at an indenting load of 100 mN, which respectively correspond to the hardness of a depth region from 15 to 30 μm apart from the blade surface and that of a depth region from 50 to 120 μm apart therefrom, in the abutting portion of the cleaning blade on the photosensitive member, and further the loss tangent of the cleaning blade at 20 to 50° C. is in a given range.

In short, Shore A hardness or repulsive elastic modulus, which is used as a physical property of any conventional cleaning blade, represents a physical property of the whole of the cleaning blade. On the other hand, in the present invention, physical properties of microscopic portions of a cleaning blade are controlled by the indentation modulus thereof, and further the Martens hardness thereof.

About the hardening treatment of surfaces of cleaning blades that has been conducted conventionally, the thickness on which the hardening treatment produces an effect is not suitable. Thus, the Martens hardness in the range of this thickness cannot be controlled into a range specified in the present application (see Comparative examples in the present specification).

The present invention has been made on the basis of the findings, and is a method of forming an image comprising processes of: a developing process to form a visible image on a photosensitive member by a toner comprising colored particles containing a binder resin and a colorant; a transferring process to transfer the visible image onto a recording material so as to form a transferred image; a fixing process to fix the transferred image; and a cleaning process to remove the toner remaining on the photosensitive member after the transfer by a cleaning blade abutting on the photosensitive means, wherein the colored particles have an average circularity of 0.95 to 0.998 and an abutting portion of the cleaning blade on the photosensitive member has an indentation modulus (A) of 5 to 15 KPa at an indenting load of 10 mN and 23° C., a ratio of the modulus (A) to an indentation modulus (B) at an indenting load of 100 mN and 23° C. of 1.1 to 1.8, and a loss tangent (tan δ) of the cleaning blade at 20 to 50° C. in the range from 0.01 to 0.1.

The cleaning blade is preferably formed of polyurethane obtained by a reaction of polyesterpolyol and polyisocyanate from the viewpoint of the durability of the blade.

According to the present invention, it is possible to prevent a spherical toner having a small particle diameter to pass through a gap between the photosensitive member and the cleaning blade in the cleaning process. When the volume average particle diameter of the colored particles is in the range from 4 to 8 μm, the ratio of the colored particles having a particle diameter of 4 μm or less is 30% or less by number, and the ratio of the colored particles having a particles diameter of 16 μm or more is 1% or less by volume, an excellent cleaning performance is obtained.

According to the present invention, it is preferable that a surface of the cleaning blade is subject to a hardening treatment to obtain an excellent cleaning performance.

In order to obtain an excellent cleaning performance, the absolute value |Q/M| of the charge amount of the toner on the surface of the photosensitive member is preferably in the range from 10 to 80 μC/g.

According to the present invention, an excellent cleaning performance is obtained even when high-speed printing is made wherein the rotating speed of the photosensitive member at the abutting portion of the cleaning blade on the photosensitive member is 10 cm/sec. or more in the cleaning process.

Furthermore, in the method of forming an image, it is preferable that the abutting portion of the cleaning blade on the photosensitive member has a Martens hardness (A) of 0.6 to 1.5 $N/mm^2$ at an indenting load of 10 mN and 23° C., and a ratio of the hardness (A) to a Martens hardness (B) at an indenting load of 100 mN and 23° C. of 1.1 to 1.8.

In the case of using the cleaning blade having the Martens hardness, it is preferable that the absolute value |Q/M| of the charge amount of the toner on the surface of the photosensitive member after the developing process and before the transferring process is in the range from 10 to 70 μC/g to obtain an excellent cleaning performance.

In the case of using the cleaning blade having the Martens hardness, an excellent cleaning performance is obtained even when high-speed printing is made wherein the rotating speed of the photosensitive member at the abutting portion of the cleaning blade on the photosensitive member is 12 cm/sec. or more in the cleaning process.

Effects of the Present Invention

According to the image forming method of the present invention as described above, an excellent cleaning performance can be maintained over a long term even when high-speed printing using a spherical toner is made, and an image can be formed in such a state that non-transferred toner and external additives less cause filming on a photosensitive member, and less give damages onto the photosensitive member.

BRIEF DESCRIPTION OF THE DRAWINGS

In the accompanying drawings.

The numerical symbol in each figure refers to the following: 1: photosensitive drum; 2: charging roller; 3: light radiating device; 4: developing device; 5: transferring roller; 6: cleaning blade; 6*a*: abutting portion on the photosensitive member; 6*b*: fixing portions; 6*c*: angle at which the cleaning blade abuts on the surface of the photosensitive member; 7: fixing device; 7*a*: heating roller; 7*b*: supporting roller; 8: casing; 8*a* toner tank; 9: developing roller; 10: blade for the developing roller; 11: supplying roller; 12: agitating blade; 13: toner; and 14: recording material.

BEST MODE FOR CARRYING OUT THE PRESENT INVENTION

Figure 1:
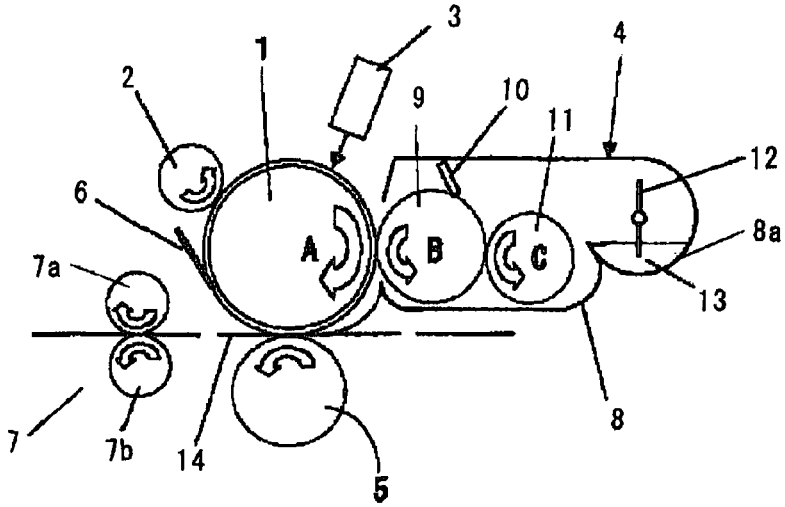
FIG. 1 is a view which illustrates a structural example of an electrophotographic machine for carrying out the image forming method according to the present invention.

FIG. 1 is a structural example of an image forming machine for carrying out the image forming method of the present invention. The electrophotographic machine illustrated in FIG. 1 has a photosensitive drum 1 as a photosensitive member. The photosensitive drum 1 is fitted thereto so as to be freely rotatable in the direction of an arrow A. The photosensitive drum 1 is a member wherein a photoconductive layer is formed on an electroconductive supporting drum. The photoconductive layer is made of, for example, an organic photosensitive material, a selenium photosensitive material, a zinc oxide photosensitive material, an amorphous silicon photosensitive material or the like. Among the above materials, a layer made of the organic photosensitive material is preferable. The photoconductive layer is bound onto the electroconductive supporting drum. Examples of a resin used to bind the photoconductive layer onto the electroconductive supporting drum include a polyester resin, an acrylic resin, a polycarbonate resin, a phenol resin, an epoxy resin and so on. Among the above, polycarbonate resin is preferable.

Around the photosensitive drum 1, a charging roller 2 as a charging member, a light radiating device 3 as an exposure device, a developing device 4, a transferring roller 5 and a cleaning blade 6 are arranged along the circumferential direction thereof.

A fixing device 7 is positioned at the downstream side of the photosensitive drum 1 and the transferring roller 5 along the direction of carry based thereon. The fixing device 7 comprises a heating roller 7*a* and a supporting roller 7*b*.

A path for carrying a recording material 14 is made to pass through a gap between the photosensitive drum 1 and the transferring roller 5, and a gap between the heating roller 7*a* and the supporting roller 7*b*.

The developing device 4 is a developing device used for a nonmagnetic one-component contact-developing method. The device 4 has a developing roller 9, a blade 10 for the developing roller for clearing away surplus toner on the developing roller, a supplying roller 11, and an agitating blade 12 for agitating toner inside a casing 8 in which a toner 13 is charged.

Processes for forming an image using the image forming machine illustrated in FIG. 1 include a charging process, an exposing process, a developing process, a transferring process, a cleaning process and a fixing process described below.

The charging process is a process of charging the surface of the photosensitive drum 1 uniformly into plus or minus by a charging member. The charging manner based on the charging member may be a contact charging manner through a fur brush, a magnetic brush, a blade or the like besides the charging roller 2 illustrated in FIG. 1, or a noncontact-charging manner using corona discharge. The manner to be used may be replaced by such a contact-charging manner or noncontact-charging manner.

The exposing process is a process of radiating light corresponding to image signals onto the surface of the photosensitive drum 1 from the light radiating device 3 as illustrated in FIG. 1, as an exposing device, so as to form an electrostatic latent image on the surface of the photosensitive drum 1 that is uniformly charged. The light radiating device 3 may be, for example, a laser radiating device or an LED radiating device.

The developing process is a process of using the developing device 4 to cause a toner to adhere onto the electrostatic latent image formed on the surface of the photosensitive drum 1 in the exposing process, so as to form a visible image. In reverse development, the toner is caused to adhere only onto the light-radiated area while in normal development, the toner is caused to adhere only onto the non-light-radiated area.

In the developing device 4 in a one-component contact-developing manner, the agitating blade 12 is arranged in a toner tank 8*a* formed at the side of the upstream of the casing 8 along the toner-supplying direction, and agitates the toner 13.

The developing roller 9 is arranged in such a manner that a part thereof contacts the photosensitive drum 1, and is made to rotate in a direction B reverse to the rotation of the photosensitive drum 1. The supplying roller 11 contacts the developing roller 9 so as to be rotated in the same direction C as the developing roller 9. The roller 11 receives the supply of the toner 13 from the toner tank 8*a* through the agitating blade 12, and causes the toner to adhere onto the outer circumference of the supplying roller 11 to supply the outer circumference of the developing roller 9. Other developing manners are a one-component noncontact-developing manner, a two-component contact-developing manner and a two-component noncontact-developing manner.

Around the developing roller 9, the developing roller blade 10 as a toner layer thickness regulating member and a toner charging member is arranged at a position between a point of the roller 9 contacting the supplying roller 11 and that of the roller 9 contacting the photosensitive drum 1. The developing roller blade 10 is made of, for example, an electroconductive rubber elastomer or metal.

The transferring process is a process of transferring the visible image formed on the surface of the photosensitive drum 1 by the developing device 4 onto the recording material 14, for example, a piece of paper. Usually, the transferring is conducted by the transferring roller 5 as illustrated in FIG. 1. Besides, belt transferring or corona transferring may be conducted.

The cleaning process is a process of cleaning the non-transferred toner remaining on the surface of the photosensitive member 1 after the transferring process. In the present invention, the cleaning blade 6 is caused to abut on the photosensitive member, thereby clearing away the non-transferred toner. The cleared non-transferred toner is usually collected by a collecting device not illustrated.

In the image forming machine illustrated in FIG. 1, the whole surface of the photosensitive member 1 is evenly charged into negative polarity or positive polarity by the charging roller 2, and then an electrostatic latent image is formed by the light radiating device 3. Furthermore, the image is developed into a visible image by the developing device 4. Next, the visible image on the photosensitive drum 1 is transferred onto the recording material 14 such as a piece of paper by the transferring roller 5, and the non-transferred toner remaining on the surface of the photosensitive drum 1 is cleaned by the cleaning blade 6. Thereafter, the machine will undergo the next image forming cycle.

The fixing process is a process of fixing the visible image transferred on the recording material 14. In the image forming machine illustrated in FIG. 1, at least one of the heating roller 7*a* heated by a non-illustrated heating means and the supporting roller 7*b* is rotated, thereby heating and pressing the recording material 14 while passing the material therebetween.

As the manner for the fixing, a manner based on heating, pressing, heating and pressing, solvent evaporation or the like is known. Among the above, the heating and pressing manner based on a heating roller as described above is most widely used.

The image forming machine illustrated in FIG. 1 is a machine for monochrome. However, the image forming method of the present invention can also be applied to a color image forming machine such as a copying machine, printer or the like for forming color images.

Figure 2:
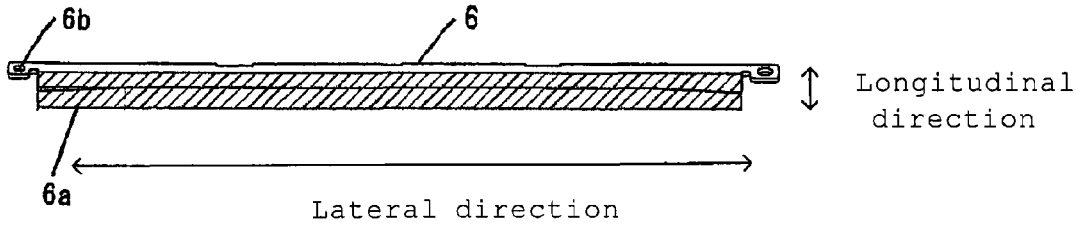
FIG. 2 is a view which illustrates an example of a cleaning blade used in the image forming method according to the present invention.
Figure 3:
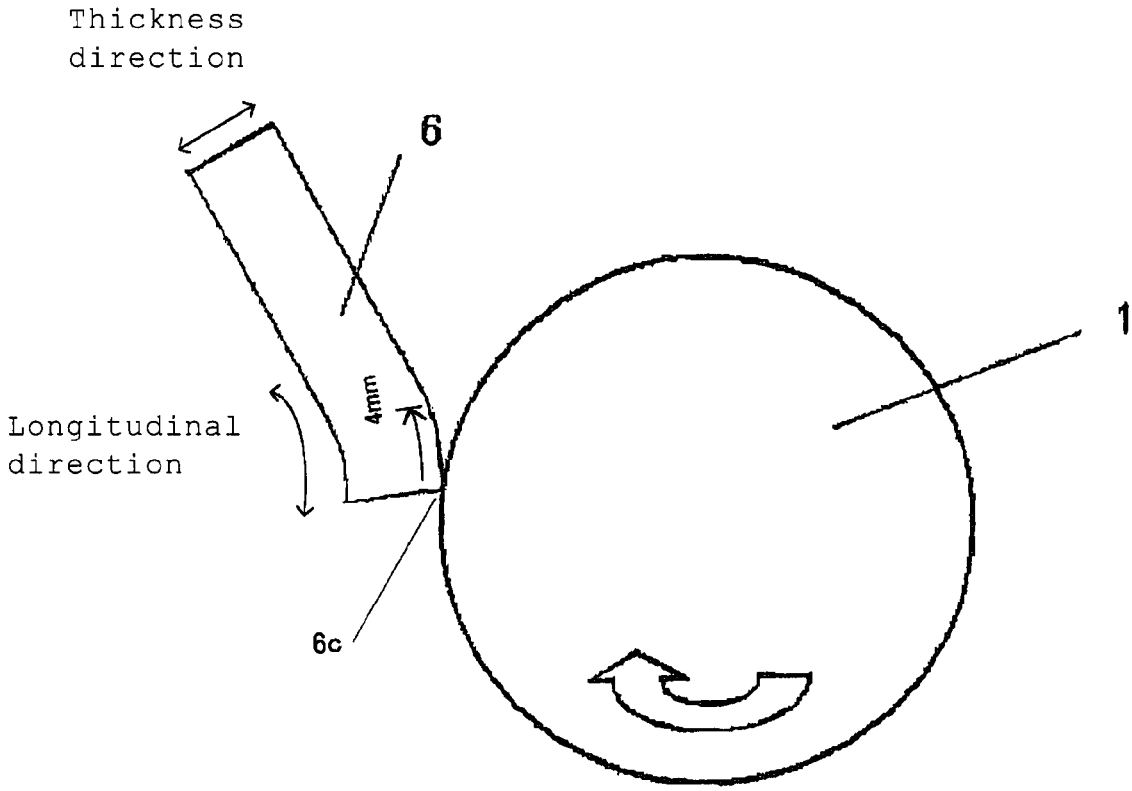
FIG. 3 is a view which schematically illustrates a state that the cleaning blade is caused to abut on a photosensitive member.

The cleaning blade used in the image forming method of the present invention may have any shape or structure as long as the cleaning blade has a shape making it possible to cause the blade to abut evenly on the photosensitive surface of the photosensitive member over the whole thereof in the direction of its rotating axis. FIG. 2 is a structural example of the cleaning blade. FIG. 3 is a view which schematically illustrates a state that the cleaning blade is caused to abut on the photosensitive member which is rotating, the state being observed from one of the ends of the rotating axis toward the other.

In FIG. 2, the cleaning blade 6 has a form which is extended in elongated shape in parallel with the axial direction of the photosensitive member and has a small thickness (laterally long and flat form), and has, along one of its sides in the longitudinal direction, an abutting portion 6*a* which abuts on the photosensitive surface of the photosensitive member. A metal fitting is fitted to the side opposite to the abutting portion 6*a*, and a fixing portion 6*b* for fixing the cleaning blade to the cleaning device is located at each of both ends of the metal fitting. The shape of a section thereof at the side of the abutting portion 6*a* is usually rectangular as illustrated in FIG. 3.

As illustrated in FIG. 3, the cleaning blade 6 abuts on the surface of the photosensitive member in the state that its tip at the abutting portion side thereof is inclined to oppose to the rotating direction of the photosensitive member surface (that is, to make the angle made between the cleaning blade and the rotating direction of the photosensitive member surface sharp). When the photosensitive member is rotated in such an abutting state, the abutting side tip of the cleaning blade 6 is somewhat deformed so that the abutting side tip of the surface of the cleaning blade 6 opposing the photosensitive member surface abuts on the photosensitive member surface.

In the present invention, the "abutting portion" as a position at which the indentation modulus (A), the indentation modulus (B), the Martens hardness (A) and the Martens hardness (B) are measured means a region from 0.5 to 4 mm apart lengthways (i.e., in a direction parallel to the flat surfaces of the cleaning blade and perpendicular to the axial direction of the photosensitive member) from a corner 6*c* of the cleaning blade which abuts on the photosensitive member surface. When the region abutting on the photosensitive member surface has an area 4 mm or more apart from the corner 6*c* of the cleaning blade, the abutting portion means a region which actually abuts on the photosensitive member surface.

When the abutting portion is subject to a surface hardening treatment, the indentation modulus or the Martens hardness of the surface-treated area of the portion is measured.

The indentation modulus is indentation modulus measured when an indenter on which a specific load (10 mN or 100 mN in the present invention) is given is indented into the cleaning blade, which is a specimen, in accordance with the procedure of an indenting test prescribed in ISO 14577. The indenter which is preferably used is a pyramidal diamond indenter having a square base and an opposing face angle $\alpha$ of 136° wherein the angle $\alpha$ is the angle between the opposing faces between which the apex is sandwiched (Vickers pyramid), or a pyramidal diamond indenter having a triangular base (for example, Verkovich pyramid).

In the present invention, the indentation modulus (A) at an indenting load of 10 mN means the elastic modulus of a very shallow moiety in the surface portion of the cleaning blade, specifically, the elastic modulus of the material in a region having depths of about 15 to 25 μm from the blade surface (the abutting portion 6*a* of the cleaning blade illustrated in FIG. 2), and the indentation modulus (B) at an indenting load of 100 mN means the elastic modulus of a deeper moiety of the cleaning blade, specifically, the elastic modulus of the material in a region having depths of about 50 to 100 μm from the blade surface.

In the image forming method of the present invention, a cleaning blade is used which has an indentation modulus (A) of 5 to 15 KPa, preferably 6 to 13 KPa at an indenting load of 10 mN and 23° C., a ratio of the modulus (A) to an indentation modulus (B) at an indenting load of 100 mN and 23° C. of 1.1 to 1.8, preferably 1.2 to 1.6, and a loss tangent (tan $\delta$) at 20 to 50° C. in the range from 0.01 to 0.1, preferably from 0.01 to 0.05.

The loss tangent (tan $\delta$) is the ratio of the loss modulus (G") of a specimen, which is related to the viscoelasticity thereof, to the storage modulus (G') thereof (the ratio of G"/G'). The viscoelasticity such as the loss modulus (G") and the storage modulus (G') can be measured with, for example, a rheometer (product name: RDA-II model, manufactured by Rheometrix Co.) or the like. When the loss tangent (tan $\delta$) becomes small, the elastic property becomes preferential over the viscous property. When the loss tangent (tan $\delta$) becomes large, the viscous property becomes preferential over the elastic property.

The cleaning blade having the above-mentioned physical properties has such a clearing-away performance that the through-pass of spherical toner is sufficiently blocked, and such a durability that the blade is not easily worn away or chipped. Therefore, even when the blade is applied to an image forming method using a spherical toner, an excellent cleaning performance can be maintained over a long term. These physical properties are remarkably exhibited, particularly, in high-speed printing wherein the rotating speed of the photosensitive member is 10 cm/sec. or more.

If the value of the indentation modulus (A) of the cleaning blade at 23° C. and an indenting load of 10 mN is out of the above-mentioned range, the cleaning performance lowers remarkably when continuous printing is made over a long term or on many sheets.

The cause thereof is presumed as follows: if the value of the indentation modulus (A) is too small, the abutting portion of the blade on the photosensitive member is easily worn way; on the other hand, if this value of the indentation modulus (A) is too large, the abutting portion of the blade is easily chipped.

If the ratio (A)/(B) of the indentation modulus (A) of the abutting portion 6*a* of the cleaning blade at 23° C. and an indenting load of 10 mN to the indentation modulus (B) at 23° C. and an indenting load of 100 mN is out of the above-mentioned range, the cleaning performance lowers remarkably as well when continuous printing is made over a long term or on many sheets.

If the value of the ratio (A)/(B) is smaller than the above range, the elastic modulus of the very shallow region in the blade surface portion is not largely different from that of the deeper region in the surface portion so that the dynamically frictional coefficient between the blade and the photosensitive member surface falls. Thus, the through-pass of the toner is easily caused so that the cleaning performance becomes insufficient.

If the value of the ratio (A)/(B) is larger than the above range, the elastic modulus of the very shallow region in the blade surface portion is largely different from that of the deeper region in the surface portion so that the adhesion between the cleaning blade and the photosensitive member is insufficient. Thus, the cleaning performance becomes insufficient, particularly, in high-speed printing wherein the rotating speed of the photosensitive member is large.

If the value of the loss tangent (tan δ) of the cleaning blade at 20 to 50° C. is out of the above-mentioned range, the cleaning performance lowers remarkably in continuous printing on many sheets.

The cause thereof is presumed as follows: if the value of the loss tangent (tan δ) is smaller than the range, the abutting portion of the blade on the photosensitive member is easily chipped; on the other hand, if this value of the loss tangent (tan δ) is larger than the range, the temperature of the abutting portion of the blade is raised by rotation contact thereof with the photosensitive member, so that the abutting portion is deformed.

Furthermore, example of means for controlling physical properties of microscopic portions of the cleaning blade include indentation hardness and Martens hardness, which are prescribed in ISO 14577.

The indentation and the Martens hardness are hardness measured when an indenter on which a specific load (10 mN or 100 mN in the present invention) is given is indented into the cleaning blade, which is a specimen, in accordance with the procedure of an indenting test prescribed in ISO 14577. The indenter which is preferably used is a pyramidal diamond indenter having a square base and an opposing face angle α of 136° wherein the angle α is the angle between the opposing faces between which the apex is sandwiched (Vickers pyramid), or a pyramidal diamond indenter having a triangular base (for example, Verkovich pyramid).

Figure 5:
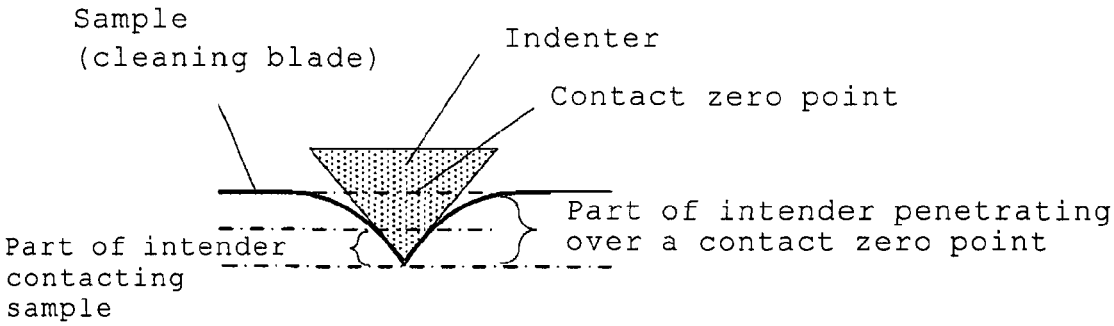
FIG. 5 is a view which schematically illustrates a state that an indenter is indented onto a cleaning blade.

As illustrated in FIG. 5, the indentation hardness is defined as the value obtained by dividing the maximum load by the projected area of the section wherein the indenter contacts the sample (the cleaning blade). Specifically, the surface area wherein a region of the indenter which penetrates so as to get over a contact zero point does not contact the sample (the cleaning blade) is not converted for the above-mentioned projected section area. Thus, particularly, about an elastomer such as rubber or the like, it is necessary to make an amendment, considering the curving angle of the sample, which is peculiar thereto.

In the meantime, the Martens hardness is defined as the value obtained by dividing a testing load by the surface area of the penetrating indenter portion when it is supposed that the whole of an indenter portion penetrating to get over the contact zero point as illustrated in FIG. 5 contacts the sample (the cleaning blade).

In the present invention, the hardness of the cleaning blade is defined by use of the Martens hardness.

In the present invention, the Martens hardness (A) at an indenting load of 10 mN means the hardness of a very shallow moiety in the surface portion of the cleaning blade, specifically, the hardness of the material in a region having depths of about 15 to 30 μm from the blade surface, and the Martens hardness (B) at an indenting load of 100 mN means the hardness of a deeper moiety of the cleaning blade, specifically, the hardness of the material in a region having depths of about 50 to 120 μm from the blade surface.

In the image forming method of the present invention, a cleaning blade is preferably used which has not only the above-mentioned indentation modules but also the following: a Martens hardness (A) of 0.6 to 1.5 N/mm$^2$, preferably 0.7 to 1.0 N/mm$^2$ at an indenting load of 10 mN and 23° C., a ratio of the hardness (A) to the Martens hardness (B) at an indenting load of 100 mN and 23° C. of 1.1 to 1.8, preferably 1.2 to 1.6, and a loss tangent (tan δ) at 20 to 50° C. in the range from 0.01 to 0.1, preferably 0.01 to 0.05.

The cleaning blade having the above-mentioned Martens hardness has such clearing-away performance that the through-pass of spherical toner is sufficiently blocked, and such durability that the blade is not easily worn away or chipped. Therefore, even when the blade is applied to an image forming method using spherical toner, an excellent cleaning performance can be maintained over a long term. These physical properties are remarkably exhibited, particularly, in high-speed printing wherein the rotating speed of the photosensitive member is 12 cm/sec. or more.

If the value of the Martens hardness (A) of the cleaning blade at 23° C. and an indenting load of 10 mN is out of the above-mentioned range, the cleaning performance lowers remarkably when continuous printing is made over a long term or on many sheets.

The cause thereof is presumed as follows: if the value of the Martens hardness (A) is too small, the abutting portion of the blade on the photosensitive member is easily worn way; on the other hand, if this value of the Martens hardness (A) is too large, the abutting portion of the blade is easily chipped.

If the ratio (A)/(B) of the Martens hardness (A) of the abutting portion 6*a* of the cleaning blade at 23° C. and an indenting load of 10 mN to the Martens hardness (B) at 23° C. and an indenting load of 100 mN is out of the above-mentioned range, the cleaning performance lowers remarkably as well when continuous printing is made over a long term or on many sheets.

If the value of the ratio (A)/(B) is smaller than the above range, the hardness of the very shallow region in the blade surface portion is not largely different from that of the deeper region in the surface portion so that the dynamically frictional coefficient between the blade and the photosensitive member surface decreases. Thus, the property of following the photosensitive member is lost so that the cleaning performance becomes insufficient.

If the value of the ratio (A)/(B) is larger than the above range, the hardness of the very shallow region in the blade surface portion is largely different from that of the deeper region in the surface portion so that the adhesion between the cleaning blade and the photosensitive member is insufficient. As a result, the distance of stick slip becomes long. Thus, particularly, in high-speed printing wherein the rotating speed of the photosensitive member is large, external additives dropping out from the toner causes filming on the photosensitive member or gives damages in the photosensitive member surface.

The stick slip phenomenon is a phenomenon that a cleaning blade abutting on a photosensitive member rubs on the photosensitive member, thereby receiving stress in the rotating direction of the photosensitive member so as to be strained, and the strain is cancelled by repulsive force of the cleaning blade. In short, it is a phenomenon that an action that the tip of the cleaning blade is involved in the rotation of the photosensitive member and then restored is repeated.

The cleaning blade, which has the above-mentioned physical properties, can be formed of a rubbery elastomer which easily gives a high elasticity, such as polyurethane, acrylonitrile/butadiene copolymer or the like. Polyurethane is particularly preferable in order to cause the blade to have the above-mentioned physical properties and reduce the generation of abrasion or chipping of the abutting portion of the blade on the photosensitive member.

The polyurethane is preferably polyurethane obtained by causing a polyol component and a polyisocyanate component to react with each other to prepare a prepolymer, adding to the prepolymer additives such as a crosslinking agent, a chain extender, an optional catalyst and so on, and then crosslinking the resultant. If necessary, the obtained polyurethane is subject to post-crosslinking in a furnace or ripening at normal temperature, thereby forming, for example, a sheet-form polyurethane elastomer. The sheet-form polyurethane elastomer is cut into a desired shape, thereby obtaining the cleaning blade.

Examples of the polyol component that can be used include alkylene glycol type polyesterpolyols, each of which is a condensate made from an alkylene glycol and an aliphatic bibasic acid (for example, polyesterpolyols each made from an alkylene glycol and adipic acid such as ethylene adipate esterpolyol, butylene adipate esterpolyol, hexylene adipate esterpolyol, ethylenepropylene adipate esterpolyol, ethylenebutylene adipate esterpolyol, ethyleneneopentylene adipate esterpolyol or the like; polycaprolactone type polyesterpolyols such as a polycaproalctone esterpolyol obtained by ring-opening-polymerizing a caprolactone or the like; and polyetherpolyols such as poly(oxytetramethylene)glycol, poly(oxypropylene)glycol or the like.

Among the above, polyesterpolyols such as alkylene glycol type polyesterpolyols, polycaprolactone type polyesterpolyols and so on are particularly preferable.

The polyisocyanate component is a compound having, in a single molecule thereof, two or more isocyanate groups.

Examples of the polyisocyanate component include aromatic polyisocyanate compounds such as 4,4'-diphenylmethanediisocyanate (MDI), 2,4-toluenediisocyanate (2,4-TDI), 2,6-toluenediisocyanate, naphthalenediisocyanate, 4,4'-phenylenediisocyanate and so on; aliphatic polyisocyanate compounds such as ethylenediisocyanate, 2,2,4-trimethylhexamethylenediisocyanate, 1,6-hexamethylenediisocyanate (HDI) and so on; and alicyclic polyisocyanate compounds such as hydrogenated 4,4'-diphenylmethanediisocyanate (HMDI), 1,4-cyclohexanediisocyanate (CHDI), methylcyclohexylenediisocyanate, isophoronediisocyanate (IPDI), hydrogenated m-xylylenediisocyanate (HXDI), norbornanediisocyanate and soon. The polyisocyanate compounds may be used alone or in combination of two or more kinds. Among the above polyisocyanate compounds, 4,4'-diphenylmethanediisocyanate is preferable.

Besides the polyol component and the polyisocyanate component, a chain extender or a crosslinking agent is preferably used.

As the chain extender, a glycol may be used. Specific examples thereof include ethylene glycol, propylene glycol, 1,4-butanediol, neopentyl glycol and so on. The chain extenders may be used alone or in combination of two or more kinds. It is preferable to use, as the chain extender, at least one of ethylene glycol and 1,4-butanediol.

As the crosslinking agent, a polyhydric alcohol having three or more functionalities can be used. Specific examples thereof include trimethylolpropane, triethylolpropane, pentaerythritol, triethanolamine and so on. The crosslinking agents may be used alone or in combination of two or more kinds. Among the above, trimethylolpropane is preferable.

Examples of the catalyst for polymerization of the polyurethane include organic tin catalyst such as dibutyltin dilaurate, tin octylate and so on; tertiary amine catalysts such as triethylenediamine, N-methylmorpholine, N,N,N',N'-tetramethylethylenediamine, N,N,N',N'-tetramethyhexamethylenediamine, 1,8-diazabicyclo[5.4.0]undecene (DBU), bis(N,N-dimethylamino-2-ethyl)ether, bis(2-dimethylaminoethyl) ether and so on; carboxylic acid salt catalysts such as potassium acetate, potassium octylate and so on; imidazole catalysts or the like. Among the above, tertiary amine catalysts are preferable.

The cleaning blade may be produced by a known method. For example, the cleaning blade may be produced by a production method including a prepolymer producing process of causing a polyol compound and polyisocyanate to react with each other to produce an isocyanate prepolymer or isocyanate pseudo-prepolymer; a mixing process of mixing components including the isocyanate prepolymer or isocyanate pseudo-prepolymer, a crosslinking agent and a chain extender to prepare a reactive composition; a molding process of using a mold or the like to make the reactive composition into a molded body having a predetermined shape; and a cutting process of cutting the sheet into a predetermined blade size, if the body is in a sheet form.

In order to adjust physical properties of the cleaning blade, it is preferable that a surface of the cleaning blade is subject to a hardening treatment. Particularly, in order to adjust the indentation modulus (A) at an indenting load of 10 mN and the ratio (A)/(B) of the modulus (A) to the indentation modulus (B) at an indenting load of 100 mN, that is, the elastic modulus of the depth of a very shallow region (about 15 to 25 μm) in the surface portion and the elastic modulus of a deeper region (about 50 to 100 μm) therein, it is preferable that a surface of the cleaning blade is subject to a hardening treatment.

Moreover, in order to adjust the Martens hardness (A) at an indenting load of 10 mN, and the ratio (A)/(B) of the hardness (A) to the Martens hardness (B) at an indenting load of 100 mN, that is, the hardness of a very shallow region (about 15 to 30 μm) in the surface portion and the hardness of a deeper region (about 50 to 120 μm) therein, it is preferable that a surface of the cleaning blade is subject to a hardening treatment.

The hardening treatment of the cleaning blade surface may be, for example, a hardening treatment of painting isocyanate dissolved in an organic solvent onto the cleaning blade surface, which is made of polyurethane, in a painting, spraying or immersing manner, and causing the polyurethane and the isocyanate to react with each other mainly in order to adjust the elastic modulus of the depth of the very shallow region in the surface portion. The above-mentioned ranges can be obtained by adjusting the concentration of the isocyanate, the reaction time, or the reaction rate in the hardening treatment. The hardening treatment may be conducted only in the abutting portion of the cleaning blade.

In the image forming method of the present invention, a toner wherein colored particles have an average circularity of 0.95 to 0.998 is used. When the average circularity is in this range, an image wherein the reproducibility of fine lines is excellent can be obtained.

In the present invention, the circle degree is defined as a value obtained by dividing the circumferential length of a circular having the same projected area as a particle image by the circumferential length of the projected image of the particle. The circle degree is used as a simple manner for representing the shape of a particle quantitatively, and is an index for representing the degree of the unevenness of a colored particle. When colored particles are perfectly spherical, the average circularity is 1. As the surface shape of colored particles becomes more complex, the value becomes smaller. The average circularity (Ca) is calculated as follows: each circle degree (Ci) is calculated with measured values of each particle which has a circular equivalent diameter of 1 μm or more using the following equation, wherein the number of the particles being n:

Circle degree (Ci)=the circumferential length of a circle equivalent to the projected area of the particle/the circumferential length of the particle projected image Next, the average circularity is obtained by the following equation:

$$\text{Average circularity} = \left(\sum_{i=1}^{n}(Ci \times fi)\right) \Big/ \sum_{i=1}^{n}(fi)$$

In the equation, fi is the frequency of the particles having circle degree Ci.

The average circularity can be measured using a flow type particle image analyzer "FPIA-1000", "FPIA-2000", or "FPIA-2100" manufactured by Sysmex Corp., or the like.

According to the present invention, in the cleaning process, it is possible particularly to inhibit a spherical toner having a small particle diameter from passing through a gap between the photosensitive member and the cleaning blade. An excellent cleaning property is obtained even when the volume average particle diameter of the colored particles is in the range from 4 to 8 μm, the ratio of the particles having a particle diameter of 4 μm or less is 30% or less by number and the ratio of the particles having a particle diameter of 16 μm or more is 1% or less by volume. In order to obtain colored particles satisfying the above particle diameter ranges, the polymerization process is preferably used.

In the case of a toner containing carrier particles such as a two-component toner, the above-mentioned volume average particle diameter, % by number and % by volume are obtained by separating and removing carrier particles in the toner and then measuring the volume average particle diameter, % by number and % by volume of the colored particles.

Even when fine particles such as external additives adhere on the surface of the colored particles, a fluctuation in the size of the colored particles by the fine particles can be ignored. It is therefore allowable to measure numerical values related to the size of the particles in the state that the fine particles adhere thereto.

In order to obtain an excellent cleaning performance, the absolute value |Q/M| of the charge amount of the toner on the surface of the photosensitive member is preferably in the range from 10 to 80 μC/g. In the case of using a cleaning blade having the above-mentioned Martens hardness, the absolute value |Q/M| of the charge amount of the toner on the photosensitive member surface is preferably in the range from 10 to 70 μC/g, more preferably from 10 to 50 μC/g.

The charge amount Q/M of the toner on the photosensitive member surface is the charge amount per unit weight of the toner which is in a use state and adheres on the photosensitive member after the developing process and before the transferring process. The charge amount of the toner on the photosensitive member surface can be measured by using a printer to make solid printing on a first sheet and start making solid printing in a second sheet, stopping the solid printing in the middle way thereof, and then measuring the charge amount (μC/g) of the toner developed on the photosensitive member with, for example, a suction type charge amount measuring device (product name: 210 HS-2A, manufactured by Trek Japan Corp.).

The toner used in the present invention will be described hereinafter.

The toner used in the present invention contains colored particles, and may optionally contain an external additive adhering to the surface of the colored particles, a carrier, which is made of particles for carrying the colored particles, or some other particle or component.

The colored particles in the toner contain a binder resin and a colorant, and may optionally contain a charge control agent or some other component.

The binder resin contained in the colored particles may be a resin that has been conventionally used as a binder resin. Examples thereof include polymers of styrene or a substitution product thereof such as polystyrene, polyvinyltoluene or the like; styrene copolymers such as a styrene/methyl acrylate copolymer, a styrene/ethyl acrylate copolymer, a styrene/butyl acrylate copolymer, a styrene/2-ethylhexyl acrylate copolymer, a styrene/methyl methacrylate copolymer, a styrene ethyl methacrylate copolymer, a styrene/butyl methacrylate copolymer, a styrene/butadiene copolymer or the like; and hydrogenated products of polymethyl methacrylate, polyester, an epoxy resin, polyvinyl butyral, an aliphatic or alicyclic hydrocarbon resin, polyolefin, an acrylic resin, a methacrylic resin, a norbornene resin or styrene resin.

As the colorant, any kinds of pigments and dyes may be used.

In the case of obtaining a monochromic toner, for example, carbon black, titanium black or the like may be used.

In the case of obtaining a full color toner (a yellow toner, a magenta toner or a cyan toner), a yellow colorant, a magenta colorant or a cyan colorant may be used respectively.

As the yellow colorant, for example, an azo pigment, a condensed polycyclic pigment or some other compound may be used. Specific examples thereof may be C.I. Pigment Yellow 3, 12, 13, 14, 15, 17, 62, 65, 73, 74, 75, 83, 90, 93, 97, 120, 138, 155, 180, 181, 185, 186 or the like.

As the magenta colorant, for example, an azo pigment, a condensed polycyclic pigment or some other compound may be used. Specific examples thereof may be C.I. Pigment Red 31, 48, 57, 58, 60, 63, 64, 68, 81, 83, 87, 88, 89, 90, 112, 114, 122, 123, 144, 146, 149, 150, 163, 170, 184, 185, 187, 202, 206, 207, 209 or 251, C.I. Pigment Violet 19 or the like.

As the cyan colorant, for example, a phthalocyanine compound such as a copper phthalocyanine compound or the like, a derivative thereof or an anthraquinone compound may be used. Specific examples thereof may be C.I. Pigment Blue 2, 3, 6, 15, 15:1, 15:2, 15:3, 15:4, 16, 17, 60 or the like.

The amount of the colorant is preferably in the range from 1 to 10 parts by weight with respect to 100 parts by weight of the binder resin.

The colored particles preferably contain a charge control agent. As the charge control agent, a charge control agent that has been conventionally used in toner can be used without any limitation. Among charge control agents, a charge control resin is preferably used. The charge control resin is high in compatibility with the binder resin and colorless, and can give a toner having a stable charging characteristic even in high-speed continuous printing.

The charge control resin is classified into a negative charge control resin and a positive charge control resin, and either one of the two is selected for use in accordance with whether the toner of the present invention is rendered a negative charge toner or a positive charge toner.

The negative charge control resin may be a resin wherein a side chain of a polymer has a substituent selected from a carboxyl group or a salt thereof, a phenol group or a salt thereof, a thiophenol group or a salt thereof, a sulfonic acid group or a salt thereof, or some other resin.

The positive charge control resin may be, for example, a resin having an amino group such as $—NH_2$, $—NHCH_3$, $—N(CH_3)_2$, $—NHC_2H_5$, $—N(C_2H_5)_2$, $—NHC_2H_4OH$ or the like, or a resin containing a functional group wherein the amino group is converted to an ammonium salt.

The used amount of the charge control resin is preferably in the range from 0.01 to 30 parts by weight, more preferably from 0.3 to 25 parts by weight, with respect to 100 parts by weight of a polymerizable monomer used to yield the binder resin.

The colored particles are each preferably the so-called core-shell type particle, which is obtained by combining two different polymers for an internal (core layer) of the particle and an external (shell layer) thereof with each other. This is because in the core-shell type particle, the balance between the performance of decreasing the lowest fixing temperature and the shelf stability of the toner can be kept good by coating a low softening point material in the internal (core layer) with a material having a higher softening point.

The method for producing the core-shell type particles is preferably a method of forming a shell layer on a core layer produced by the polymerization process in an in-situ method.

The toner of the present invention preferably contains an external additive. When the external additive is caused to adhere on the surface of the colored particle or is buried into the particle, the charging characteristic, the fluidity, the shelf stability or some other property of the toner can be adjusted.

As the external additive, an external additive that has been conventionally used in toner can be used without any limitation. Examples thereof include inorganic particles and organic resin particles. Examples of the inorganic particles include silica, aluminum oxide, titanium oxide, zinc oxide, tin oxide and so on. Examples of the organic resin particles include acrylic (or methacrylic) acid ester polymer particles, styrene/acrylic (or methacrylic) acid ester copolymer particles and so on. Among the above, silica or titanium oxide is suitable and particles the surfaces of which are treated to obtain hydrophobicity are preferable. Silica particles treated for obtaining hydrophobicity are particularly preferable.

The amount of the external additive may not be particularly limited, and is usually in the range from 0.1 to 6 parts by weight with respect to 100 parts by weight of the colored particles. About the external additive, two or more species thereof may be used in combination. When combined external additive species are used, a method of combining inorganic particles different in average particle diameter, or inorganic particles and organic resin particles is preferable. In order to cause the external additive to adhere on the colored particles, usually, the adhering is conducted by stirring the external additive and the colored particles by a mixing machine such as a Henschel mixer.

In the present invention, the colored particles obtained by the above-mentioned method may be used as a one-component toner for developing electrostatic latent image. The particles can be made into a two-component toner for developing electrostatic latent image by mixing the particles with a carrier by a high-speed stirring machine such as a Henschel mixer or the like.

According to the image forming method of the present invention, an excellent cleaning performance is exhibited over a long term, the performance being capable of coping with a case of using a toner containing colored particles having a high sphericity and having a small particle diameter and a sharp particle diameter distribution, such as polymerization process toner.

According to the image forming method of the present invention, an excellent cleaning performance is exhibited even when a high-speed printing is made in which the relative speed between the cleaning blade and the photosensitive member at the portion where the cleaning blade abuts on the photosensitive member, that is, the rotating speed of the photosensitive member is 10 cm/sec. or more.

Accordingly, the image forming method of the present invention is carried out suitably for an image forming method coping with high image quality and high-speed printing.

EXAMPLES

Hereinafter, the present invention will be more specifically described by way of examples. Of course, the scope of the present invention is not limited to the examples. In the examples, the words "part(s)" and the symbol "%" represent part(s) by weight and % by weight, respectively, unless otherwise specified. A HH (high temperature and high humidity) environment, represents an environment of 28° C. temperature and 80% humidity, a NN (normal temperature and normal humidity) environment represents an environment of 23° C. temperature and 50% humidity, and a LL (low temperature and low humidity) environment represents an environment of 10° C. temperature and 20% humidity.

Example A Series

Cleaning blades used in Examples 1A to 3A and Comparative Examples 1A to 3A and a toner used commonly in Examples 1A to 3A and Comparative Examples 1A to 3A were produced, and tests were made in accordance with procedures described below.

[Production of a Cleaning Blade of Example 1A]

At 70° C., 86.36 parts of polycaprolactone esterdiol (average molecular weight: 2,000), which is a bifunctional polyesterpolyol, as a polyol component were heated and stirred under a reduced pressure (5 mmHg) for 3 hours so as to be dehydrated. Thereto were added 43.12 parts of 4,4'-diphenylmethanediisocyanate (MDI) as a polyisocyanate component to cause the two to react with each other at 80° C. in a flow of nitrogen gas for 3 hours, thereby yielding an NCO-group-terminated pseudo-prepolymer.

To the NCO-group-terminated pseudo-prepolymer heated to 80° C., a hardening agent component made of a mixture composed of 16.70 parts of polycaprolactone esterdiol (average molecular weight: 2,000), 3.12 parts of trimethylolpropane (TMP) as a crosslinking agent and 7.21 parts of 1,4-butanediol (BD) as a chain extender was added, and then the resultant was stirred and defoamed under a reduced pressure to yield a reactive composition.

The resultant reactive composition was cast into a cylindrical mold having, as its inner face, a molding surface having a diameter of 340 mm and a width of 600 mm, and then heated at 150° C. for 1 hour so as to be cured. In this way, a sheet-form polyurethane elastomer having a thickness of 1.6 mm was formed by the molding.

For a surface hardening treatment thereof, the formed sheet-form polyurethane elastomer was immersed in a 3% by weight solution of MDI in cyclohexane for 3 minutes, and the surface of the elastomer were washed with cyclohexane. Thereafter, the resultant was post-cured at 105° C. for 6 hours, and further left at room temperature for 7 days.

The sheet-form polyurethane elastomer allowed to be left was cut into a cleaning blade of Example 1A having a length of 12 mm and a width of 238 mm. A hot melt adhesive was used to stick the blade on a predetermined metal fitting, thereby yielding a cleaning blade unit of Example 1A.

[Production of a Cleaning Blade of Example 2A]

In the same operation as in the production of the cleaning blade of Example 1A, the steps from the start to the molding using the mold were conducted. About the resultant sheet-form polyurethane elastomer, 1.6 mm thickness, a solution of butyl acrylate in 2,2-dimethoxy-1,2-diphenylethane-1-one (product name: IRGACURE 651, manufactured by Nagase & Co., Ltd.) (concentration: 3% by weight) was painted onto its blade surface for a surface hardening treatment thereof. The blade portion was spot-cured with a UV-LED radiating device (product name: UV-400, manufactured by Keyence Co.) for 1 minute, and further post-cured at 105° C. for 6 hours. Furthermore, the resultant was left at room temperature for 7 days.

The sheet-form polyurethane elastomer allowed to be left was cut into a cleaning blade of Example 2A having a length of 12 mm and a width of 238 mm. A hot melt adhesive was used to stick the blade on a predetermined metal fitting, thereby yielding a cleaning blade unit of Example 2A.

[Production of a Cleaning Blade of Example 3A]

To 100 parts by weight of polybutylene adipate diol (average molecular weight: 2,000), 117.6 parts by weight of MDI were added, and the resultant was stirred at 70° C. in the atmosphere of nitrogen gas for 1 to 4 hours to prepare a prepolymer having a contained-isocyanate-group amount of 16.3% by weight.

Separately, a hardening agent composition made of a mixture of: 77.5 parts by weight of polybutylene adipate diol (average molecular weight: 2,000); 11.9 parts by weight of a hardening agent wherein 1,4-butanediol and trimethylolpropane were mixed with each other at a ratio by weight of 60/40; and 0.19 part by weight of a temperature-sensitive catalyst (product name: SA 1102, manufactured by San-Apro Ltd.), was prepared.

The prepolymer and the hardening agent composition obtained as described above were mixed with each other, and the mixture was stirred to prepare a reactive composition. Thereafter, the composition was vacuum-defoamed, cast into a cylindrical mold having, as its inner face, a molding face having a diameter of 340 mm and a width of 600 mm, and then heated at 150° C. for 1 hour so as to be cured. In this way, a sheet-form polyurethane elastomer having a thickness of 1.6 mm was formed by the molding.

For a surface hardening treatment thereof, the formed sheet-form polyurethane elastomer was taken out from the mold, and immersed in a 3% by weight solution of MDI in cyclohexane for 3 minutes. The surface of the elastomer was washed with cyclohexane, and then the elastomer was post-cured at 105° C. for 6 hours. Furthermore, the elastomer was left at room temperature for 7 days.

The sheet-form polyurethane elastomer allowed to be left was cut into a cleaning blade of Example 3A having a length of 12 mm and a width of 238 mm. A hot melt adhesive was used to stick the blade on a predetermined metal fitting, thereby yielding a cleaning blade unit of Example 3A.

[Production of a Cleaning Blade of Comparative Example 1A]

In the same operation as in the production of the cleaning blade of Example 1A, the steps from the start to the molding using the mold were conducted, and a sheet-form polyurethane elastomer, 1.6 mm in thickness, was yielded.

The sheet-form polyurethane elastomer was post-cured at 105° C. for 6 hours, and further left at room temperature for 7 days. The resultant was not subject to the surface hardening treatment.

The sheet-form polyurethane elastomer allowed to be left was cut into a cleaning blade of Comparative Example 1A having a length of 12 mm and a width of 238 mm. A hot melt adhesive was used to stick the blade onto a predetermined metal fitting, thereby yielding a cleaning blade unit of Comparative Example 1A.

[Production of a Cleaning Blade of Comparative Example 2A]

In the same operation as in the production of the cleaning blade of Example 1A, the steps from the start to the molding using the mold were conducted. The resultant sheet-form polyurethane elastomer, 1.6 mm in thickness, was masked with a tape so as to make a tip cleaning region of the elastomer exposed by 3 mm (about 40% of the length in the longitudinal direction) The resultant was immersed in an isocyanate (MDI) of 80° C. temperature for 30 minutes, and then the sheet-form polyurethane elastomer was pulled up. Extra MDI was wiped off with a cloth into which cyclohexane was impregnated, and then the masking was taken off.

Thereafter, in an oven of 130° C. temperature, the impregnated isocyanate compound was caused to react with the polyurethane resin for 60 minutes. Thereafter, the resultant was further left at room temperature for 7 days.

The sheet-form polyurethane elastomer allowed to be left was cut to leave the immersed portion of the sheet-form polyurethane elastomer, thereby forming a cleaning blade of Comparative Example 2A having a length of 12 mm and a width of 238 mm. A hot melt adhesive was used to stick the blade on a predetermined metal fitting, thereby yielding a cleaning blade unit of Comparative Example 2A.

[Production of a Cleaning Blade of Comparative Example 3A]

In the same operation as in the production of the cleaning blade of Example 1A, the steps from the start to the molding using the mold were conducted. The resultant sheet-form polyurethane elastomer, 1.6 mm in thickness, was masked with a tape so as to make a tip cleaning region of the elastomer exposed by 3 mm (about 40% of the length in the longitudinal direction). By plasma chemical vapor deposition, an evaporated layer of flexible diamond-like carbon (FDLC), 2 μm in thickness, was formed on long-side faces and a forward face of the base elastomer, which would form edges of the elastomer being substrate. In this way, a sheet-form polyurethane elastomer wherein the flexible diamond-like carbon (FDLC) layer was formed on a portion abutting on a photosensitive member was yielded.

The sheet-form polyurethane elastomer was cut to leave the coated portion of the elastomer, thereby forming a cleaning blade of Comparative Example 3A having a length of 12 mm and a width of 238 mm. A hot melt adhesive was used to stick the blade on a predetermined metal fitting, thereby yielding a cleaning blade unit of Comparative Example 3A.

[Production of a Toner]

(A-1. Preparation of a Charge Control Resin Composition)

Into 100 parts of a charge control resin (the ratio between monomers constituting the resin: styrene/n-butyl acrylate/dimethyl methacrylate aminobenzyl chloride=82%/11%/7%, weight-average molecular weight: 12,000 and glass transition temperature: 67° C.), 24 parts of toluene and 6 parts of methanol were dispersed, and the resultant was kneaded by two rollers while cooled without being heated. After the charge control resin was wound around the rollers, 100 parts of a magenta pigment (C.I. Pigment 122, manufactured by Clariant Co.) were gradually added thereto. The resultant was kneaded and dispersed, thereby yielding a charge control resin composition. About the interval between the rollers, the initial value thereof was 1 mm. The interval was gradually made wide so as to be extended to 3 mm. The kneading was performed for 1 hour. In the middle thereof, an organic solvent was intermittently added several times in accordance with the state of the kneaded charge control resin.

(A-2. Preparation of a Colloidal Solution)

To an aqueous solution wherein 9.8 parts of magnesium chloride were dissolved in 250 parts of ion exchange water, an aqueous solution wherein 6.9 parts of sodium hydroxide were dissolved in 50 parts of ion exchange water was gradually added under stirring, so as to prepare a liquid dispersion of magnesium hydroxide colloid (hardly water-soluble inorganic hydroxide colloid) as a dispersion stabilizer.

(A-3. Polymerizable Monomer Composition)

The following were stirred and mixed to disperse uniformly by use of a bead mill: 80.5 parts of styrene; 19.5 parts of n-butyl acrylate; 12 parts of the charge control resin composition; 0.6 part of divinylbenzene; 1 part of triisobutylmercaptan; 1 part of tetraethylthiuram disulfide; 0.8 part of a polymethacrylate macromonomer (product name: AA-6, manufactured by Toagosei Co., Ltd.); and 10 parts of dipentaerythritol hexamyristate. Thus, a polymerizable monomer composition was obtained.

(A-4. Aqueous Dispersion of a Polymerizable Monomer for Shell)

An ultrasonic emulsifying device was used to subject 2 parts of methyl methacrylate (Tg=105° C. according to calculation) and 100 parts of water to finely dispersing treatment, thereby yielding an aqueous dispersion of the monomer for shell. The particle diameter of droplets of the shell monomer was measured with a particle diameter distribution measuring device (product name: SALD 2000A model, manufactured by Shimadzu Corp.). As a result, the D90 thereof was 1.6 μm.

(A-5. Production of Colored Polymer Particles)

The polymerizable monomer composition was charged into the magnesium hydroxide colloidal dispersion obtained as described above, and the resultant was stirred until droplets therein were stabilized. Thereto, 6 parts of t-butylperoxy-2-ethyl hexanoate (product name: PERBUTYL O, manufactured by NFO Corp.) were added as a polymerization initiator, and then an emulsifying/dispersing machine (product name: EBARA MILDER, manufactured by Ebara Corp.) was used to stir the resultant at a spinning rate of 15,000 rpm under the application of a high shearing force for 30 minutes, thereby forming droplets of the polymerizable monomer composition. The aqueous dispersion with droplets of the polymerizable monomer composition was put into a 10 L reactor to which stirring fans were mounted so as to start polymerization reaction at 90° C. When the polymerization conversion ratio reached substantially 100%, a sample was taken therefrom to measure the particle diameter of the colored particles (core). As a result, the volume average particle diameter was 7.4 μm.

The aqueous dispersion of the polymerizable monomer for shell and 0.2 part of a water-soluble initiator (product name: VA-086; 2,2'-azobis[2-methyl-N-(2-hydroxyethyl)-propioneamide], manufactured by Wako Pure Chemical Industries, Ltd.) were dissolved in 65 parts of distilled water, and the solution was charged into a reactor. Furthermore, the polymerization was continued for 8 hours, and then the reaction was stopped to yield an aqueous dispersion of colored particles having a pH of 9.5.

While the aqueous dispersion of the colored particles, yielded as described above, was stirred, the pH of the system was made into 5 or less with sulfuric acid. The system was washed with an acid (at 25° C. for 10 minutes), and then water was separated by filtration. Thereafter, thereto newly 500 parts of ion exchange water were added to prepare a slurry again. The slurry was washed with water. Subsequently, dehydration and washing with water were again repeated several times to filtrate off a solid. In a drier, the solid was then dried at 45° C. for 2 days (48 hours) to yield colored particles.

The dried colored particles were taken out, and the volume average particle diameter (dv) was measured. The diameter was 7.4 μm. The ratio of the volume average particle diameter (dv)/the number average particle diameter (dp) was 1.23.

(A-6. Preparation of a Toner)

To 100 parts of the colored particles obtained as described above, 0.6 part of a colloidal silica (product name: RX-300, manufactured by Nippon Aerosil Co., Ltd.) treated for obtaining hydrophobicity and 0.3 part of calcium carbonate (product name: CUBE-03BHS, manufactured by Maruo Calcium Co., Ltd.) having a number average particle diameter of 0.3 μm were added, and then a Henschel mixer was used to mix these components with each other to prepare a nonmagnetic one-component toner.

[Test Methods]

About each of the cleaning blades, the following were measured: the indentation modulus (A) at 23° C. and an indenting load of 10 mN, the ratio (A)/(B) of the indentation modulus (A) at 23° C. and an indenting load of 100 mN to the indentation modulus (B) at 23° C. and an indenting load of 100 mN, and the loss tangent (tan δ) at 20 to 50° C.

(A-1. Measurement of the Indentation Modules (A) and (B))

The measurement was made in accordance with the procedure of an indenting test prescribed in ISO 14577. (10 sec. for 10 mN and 15 sec. for 100 mN). A used test device was a supermicro hardness tester (product name: FISCHERSCOPE 100C, manufactured by Fischer Instruments K.K.). A used indenter was a pyramidal diamond indenter having a square base and an opposing face angle of 136°.

The temperature in the test was set to 23° C., and the indenter was indented into the vicinity of a portion of the cleaning blade abutting on a photosensitive member (see FIG. 3. In the surface abutting on the photosensitive member, a region extending from the abutting corner thereof by a length of 4 mm in the longitudinal direction). A load was applied thereto until the load was turned into 10 mN or 100 mN. This state was kept for 20 seconds, and then the elastic modulus was measured when the abutting portion was relaxed.

Figure 4:
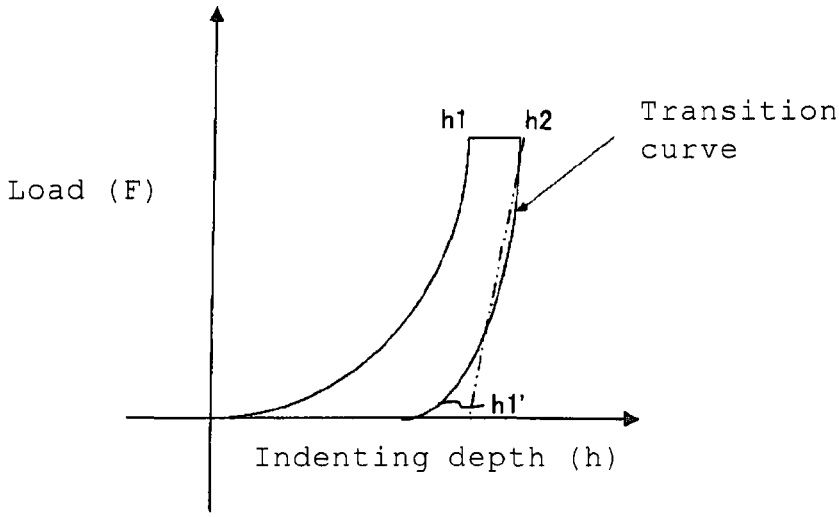
FIG. 4 is a graph showing a transition curve obtained from relationship between load and indenting depth.

The indentation modulus Eit was measured about each of the test pieces using a square pyramidal diamond indenter. The indentation modulus was calculated as follows. A load was applied to the test piece at a constant speed. From the depth and the shape of the intender at this time, an indentation curve thereof and the area function of a predetermined indenter, the contact area between the intender and the test piece was estimated. The load at this time was divided by the contact area so as to estimate the indentation hardness. A load of 10 mN or 100 mN was applied thereto, and then the load was kept for about 20 seconds. The load at this time was regarded as 100%. Thereafter, the load was lowered at a constant rate. From a transition curve (see FIG. 4) obtained by the measurement, a line was drawn to pass on the value at an indenting load of 95% and the value at an indenting load of 60%. The inclination at this time was defined as the indentation modulus.

(A-2. Measurement of the Loss Tangent (tan δ) at 20 to 50° C.)

While the temperature was raised at a constant frequency, a rheometer (product name: RDA-II model, manufactured by Rheometrix Co.) was used to measure the viscoelasticity at individual temperatures. The loss tangent (tan δ) was then calculated out.

Conditions for the measurement are as follows:

<Measurement Conditions>

Measuring tool: a parallel plate having a diameter of 7.9 mm was used when the elastic modulus was high, and a parallel plate having a diameter of 25 mm was used when the elastic modulus was low.

Measuring sample: each of the cleaning blades was cut into a piece 25×2×1.5 mm, and this was used as a sample.

Measuring frequency: 6.28 radian/second

Measurement strain: the initial value thereof was set to 0.1%.

Extension correction of the sample: adjusted in an automatic measurement mode

Measuring temperature: the temperature was raised at a rate of 1° C. per minute in the range from 20 to 50° C.

(A-3. Measurement of the Average Circularity and the Particle Diameter)

Into a container, 10 mL of ion exchange water was added preliminarily, and thereto, 0.02 g of a surfactant (alkylbenzenesulfonic acid) was added as a dispersing agent. Thereto, further 0.02 g of the toner was added, and the resultant was subject to dispersing treatment with an ultrasonic dispersing device at 60 W for 3 minutes. Thereto, an appropriate amount of ion exchange water was added to set the toner concentration in the range of 3,000 to 10,000 particles/μL when a measurement was made as follows: a flow type particle image analyzer (product name: FPIA-2100, manufactured by Sysmex Corp.) was used to measure 1,000 to 10,000 colored particles having a circular equivalent diameter of 1 μm or more. From the measured values, the following were obtained: the average circularity, the volume average particle diameter (μm), the ratio (% by number) of particles having a particle diameter of 4 μm or less and the ratio (by volume) of particles having a particle diameter of 16 μm or more.

(A-4. Measurement of the Absolute Value |Q/M| of the Charge Amount of the Toner on the Photosensitive Member Surface)

Each of the cleaning blade units produced in Examples and Comparative Examples described above was set up to a commercially available nonmagnetic one-component printer (organic photosensitive developing drum, printing speed: 24 sheets per minute). To this printer, a cartridge filled with the toner which was prepared by the above-mentioned method and then allowed to be left in the NN environment for one day (24 hours) was mounted. Printing was then performed in the NN environment to make evalustion. The rotating speed of the photosensitive member surface at its point abutting on the cleaning blade (abutting portion) was set to 12 cm/sec.

First, white solid printing was made on a first sheet. Next, white solid printing was started on a second sheet and the printing was stopped in the middle way thereof. Thereafter, the absolute value |Q/M| (μC/g) of the charge amount of the toner adhering onto the photosensitive member was measured with a suction type charge amount measuring device (product name: 210 HS-2A, manufactured by Trek Japan Corp.).

(A-5. Evaluation of the Reproducibility of Fine Lines)

The toner prepared by the above-mentioned method was allowed to be left in the NN environment for one day, and then the printer used in the test A-4 was used to form line images continuously using 2×2 dot lines (line width: about 85 μm, i.e. 600 dpi). The printing was performed for 10,000 sheets. The rotating speed of the photosensitive member surface at its point abutting on the cleaning blade (abutting portion) was set to 12 cm/sec.

At intervals of 500 sheets out of the printed sheets, measurement was made using a print evaluating system (product name: RT 2000, manufactured by YA-MA Co.) to sample density distribution data of the line images. At this time, the overall width of the line image at the density giving a half of the largest value in the density distribution was used as a line width to be evaluated. The line width of the line images on the first sheet was used as a reference. When the difference between the reference and the line width to be evaluated was 10 μm or less, an evaluation that the line images on the first sheet were reproduced was made. In such a way, the number of the sheets on which the difference in line width between the line images was able to be kept at a value of 10 μm or less was examined.

(A-6. Evaluation of the Cleaning Performance)

The toner prepared by the above-mentioned method was allowed to be left in the NN or LL environment for one day (24 hours), and then the printer used in the test A-4 was used to print halftone images having a print density of 5% continuously. The printing was made on 10,000 sheets. The rotating speed of the photosensitive member surface at its point abutting on the cleaning blade (abutting portion) was set to 12 cm/sec.

At intervals of 500 sheets out of the printed sheets, the surface of the charging roller was visually observed. The number of the sheet printed when a matter that non-transferred toner which had passed over the cleaning blade adhered on the charging roller surface was recognized was defined as the number of the cleaning-defect-generated sheet.

[Results]

The test results of the Example A series are shown in Tables 1-1 and 1-2.

Abbreviations in Tables 1-1 and 1-2 are as follows:

*1: abbreviations of monomers for binder resin, and polymerizable monomers for shell: ST (styrene), BA (butyl acrylate), DVB (divinylbenzene), MMA (methyl methacrylate) and AA-6 (MMA macromonomer)

TABLE 1-1

| | | Example 1A | Example 2A | Example 3A | Comparative Example 1A | Comparative Example 2A | Comparative Example 3A |
|---|---|---|---|---|---|---|---|
| Toner composition | Binder resin (ratio by weight of charged amounts) *1 | ST/BA/DVB (80.5/19.5/0.6) | Same as in Example 1A | Same as in Example 1A | Same as in Example 1A | Same as in Example 1A | Same as in Example 1A |
| | Monomer added to binder resin | AA6 (0.8 part) | Same as in Example 1A | Same as in Example 1A | Same as in Example 1A | Same as in Example 1A | Same as in Example 1A |
| | Colorant | PR122 (7 parts) | Same as in Example 1A | Same as in Example 1A | Same as in Example 1A | Same as in Example 1A | Same as in Example 1A |
| | Charge control agent | Charge control resin (6 parts) | Same as in Example 1A | Same as in Example 1A | Same as in Example 1A | Same as in Example 1A | Same as in Example 1A |
| | Monomer for shell | MMA (0.5 part) | Same as in Example 1A | Same as in Example 1A | Same as in Example 1A | Same as in Example 1A | Same as in Example 1A |
| Cleaning blade | Base material | Polyurethane elastomer | Same as in Example 1A | Same as in Example 1A | Same as in Example 1A | Same as in Example 1A | Same as in Example 1A |
| | Constituting ingredient (polyol) | Polycaprolactone esterdiol | Same as in Example 1A | Polybutylene adipate diol | Same as in Example 1A | Same as in Example 1A | Same as in Example 1A |
| | Tan δ (maximum) | 0.03 | Same as in Example 1A | 0.04 | 0.06 | 0.03 | Same as in Com. Ex. 2A |
| | Tan δ (minimum) | 0.02 | Same as in Example 1A | 0.03 | 0.03 | 0.02 | Same as in Com. Ex. 2A |
| | 10 mN indentation modulus (A) (KPa) | 11.2 | 7.6 | 10.4 | 10.4 | 20.6 | 5.5 |
| | 100 mN indentation modulus (B) (KPa) | 7.9 | 5.8 | 6.1 | 5.2 | 20.0 | 5.3 |
| | (A)/(B) | 1.4 | 1.3 | 1.7 | 2.0 | 1.0 | 1.0 |
| | Rotating speed (cm/sec.) of photosensitive member at abutting portion | 12 | Same as in Example 1A | Same as in Example 1A | Same as in Example 1A | Same as in Example 1A | Same as in Example 1A |

TABLE 1-2

| | | Example 1A | Example 2A | Example 3A | Comparative Example 1A | Comparative Example 2A | Comparative Example 3A |
|---|---|---|---|---|---|---|---|
| Toner physical properties | Average circularity | 0.978 | Same as in Example 1A | Same as in Example 1A | Same as in Example 1A | Same as in Example 1A | Same as in Example 1A |
| | Volume average particle diameter (μm) | 6.4 | Same as in Example 1A | Same as in Example 1A | Same as in Example 1A | Same as in Example 1A | Same as in Example 1A |
| | Ratio (% by number) particles 4 μm or less in diameter | 18 | Same as in Example 1A | Same as in Example 1A | Same as in Example 1A | Same as in Example 1A | Same as in Example 1A |
| | Ratio (% by volume) particles 16 μm or more in diameter | 0.05 | Same as in Example 1A | Same as in Example 1A | Same as in Example 1A | Same as in Example 1A | Same as in Example 1A |
| | \|Q/M\| (μC/g) | 35 | Same as in Example 1A | Same as in Example 1A | Same as in Example 1A | Same as in Example 1A | Same as in Example 1A |
| Evaluation results | Fine line reproducibility (NN) | 10,000 | 10,000 | 10,000 | 9,000 | 7,000 | 1,500 |
| | Cleaning property (NN) | 10,000 | 10,000 | 10,000 | 8,000 | 7,000 | 1,500 |
| | Cleaning property (LL) | 10,000 | 10,000 | 8,500 | 2,000 | 6,500 | 500 |

(Survey of Results)

In the Example A series, the small-particle-diameter spherical toner was used to make the continuous printing test, wherein high-speed continuous printing was performed. As a result, in Examples 1A to 3A, an excellent cleaning performance and an excellent fine line reproducibility were exhibited over a long term. On the other hand, in Comparative Examples 1A to 3A, a deterioration in the cleaning performance or the fine line reproducibility was recognized in the early stage.

In Comparative Example 1A, the indentation modulus (A) of the cleaning blade at 23° C. and an indenting load of 10 mN was 10.4, which was in the range of 5 to 15 KPa, but the value of the indentation modulus (B) at an indenting load of 100 mN was too small. Thus, the ratio (A)/(B) was 2.0, which was over the upper limit of the range of 1.1 to 1.8. Regarding the results of the continuous printing test of Comparative Example 1A, all of the evaluation items of the cleaning performance in the LL or NN environment and the fine line reproducibility in the NN environment were poorer than those of Examples 1A to 3A. The cleaning performance in the NN environment and the fine line reproducibility in the NN environment were not very poor, but it was particularly characteristic that the cleaning performance in the LL environment was deteriorated in a quite early stage.

As for Comparative Example 2A, the indentation modulus (A) of the cleaning blade at 23° C. and an indenting load of 10 mN was 20.6, which was over the upper limit of the range of 5 to 15 KPa. The ratio (A)/(B) was 1.0, which was smaller than the lower limit of the range of 1.1 to 1.8. The cleaning blade used in Comparative Example 2 was similar to the cleaning blade disclosed in JP-A No. 2001-343874. Regarding the results of the continuous printing test of Comparative Example 2A, all of the evaluation items of the cleaning performance in the LL or NN environment and the fine line reproducibility in the NN environment were poorer than those of Examples 1A to 3A. Particularly, it was characteristic that all of the evaluation items were deteriorated in a quite early stage.

As for Comparative Example 3A, the indentation modulus (A) of the cleaning blade at 23° C. and an indenting load of 10 mN was 5.5, which was in the range of 5 to 15 KPa. However, the value of the indentation modulus (A) at an indenting load of 10 mN was far smaller than that of the indentation modulus (B) at an indenting load of 100 mN. Thus, the ratio (A)/(B) was 1.0, which was smaller than the lower limit of the range of 1.1 to 1.8. The cleaning blade used in Comparative Example 3A was similar to the cleaning blade disclosed in JP-A No. 2003-103686. Regarding the results of the durable printing test of Comparative Example 3A, all of the evaluation items of the cleaning performance in the LL or NN environment and the fine line reproducibility in the NN environment were poorer than those of Examples 1A to 3A. Particularly, it was characteristic that all of the evaluation items were deteriorated in a quite early stage.

Example B Series

Cleaning blades used in Examples 1B to 3B and Comparative Examples 1B to 4B, and a toner used commonly in Examples 1B to 3B and Comparative Examples 1B to 3B were produced and tests were made in accordance with procedures described below.

[Production of a Cleaning Blade of Example 1B]

At 70° C., 86.36 parts of polycaprolactone esterdiol (average molecular weight: 2,000), which is a bifunctional polyesterpolyol, as a polyol component were heated and stirred under a reduced pressure (5 mmHg) for 3 hours so as to be dehydrated. Thereto, 43.12 parts of 4,4'-diphenylmethanediisocyanate (MDI) were added as a polyisocyanate component to cause the two to react with each other at 80° C. in a flow of nitrogen gas for 3 hours, thereby yielding an NCO-group-terminated pseudo-prepolymer.

To the NCO-group-terminated pseudo-prepolymer heated to 80° C., a hardening agent component made of a mixture composed of 16.70 parts of polycaprolactone esterdiol (average molecular weight: 2,000), 3.12 parts of trimethylolpropane (TMP) as a crosslinking agent and 7.21 parts of 1,4-butanediol (BD) as a chain extender was added, and then the resultant was stirred and defoamed under a reduced pressure to yield a reactive composition.

The resultant reactive composition was cast into a cylindrical mold having, as its inner face, a molding face having a diameter of 340 mm and a width of 600 mm, and then heated at 150° C. for 1 hour so as to be cured. In this way, a sheet-form polyurethane elastomer having a thickness of 1.6 mm was formed by the molding.

For a surface hardening treatment thereof, the formed sheet-form polyurethane elastomer was immersed in a 3% by weight solution of MDI in cyclohexane for 3 minutes, and the surface of the elastomer were washed with cyclohexane. Thereafter, the resultant was post-cured at 105° C. for 6 hours, and further left at room temperature for 7 days.

The sheet-form polyurethane elastomer allowed to be left was cut into a cleaning blade of Example 1B having a length of 12 mm and a width of 238 mm. A hot melt adhesive was used to stick the blade on a predetermined metal fitting, thereby yielding a cleaning blade unit of Example 1B.

[Production of a Cleaning Blade of Example 2B]

To 100 parts by weight of polybutylene adipate diol (average molecular weight: 2,000), 117.6 parts by weight of MDI were added, and the resultant was stirred at 70° C. in the atmosphere of nitrogen gas for 1 to 4 hours to prepare a prepolymer having a contained-isocyanate amount of 16.3% by weight.

Separately, a hardening agent composition made of a mixture of: 77.5 parts by weight of polybutylene adipate diol (average molecular weight: 2,000); 11.9 parts by weight of a hardening agent wherein 1,4-butanediol and trimethylolpropane were mixed with each other at a ratio by weight of 60/40; and 0.19 part by weight of a temperature-sensitive catalyst (product name: SA 1102, manufactured by San-Apro Ltd.), was prepared.

The prepolymer and the hardening agent composition obtained as described above were mixed with each other, and the mixture was stirred to prepare a reactive composition. Thereafter, the composition was vacuum-defoamed, cast into a cylindrical mold having, as its inner face, a molding surface having a diameter of 340 mm and a width of 600 mm, and then heated at 150° C. for 1 hour so as to be cured. In this way, a sheet-form polyurethane elastomer having a thickness of 1.6 mm was formed by the molding.

For a surface hardening treatment thereof, the formed sheet-form polyurethane elastomer was taken out from the mold, and immersed in a 3% by weight solution of MDI in cyclohexane for 3 minutes. The surfaces of the elastomer were washed with cyclohexane, and then the elastomer was post-cured at 105° C. for 6 hours. Furthermore, the elastomer was left at room temperature for 7 days.

The sheet-form polyurethane elastomer allowed to be left was cut into a cleaning blade of Example 2B having a length of 12 mm and a width of 238 mm. A hot melt adhesive was used to stick the blade on a predetermined metal fitting, thereby yielding a cleaning blade unit of Example 2B.

[Production of a Cleaning Blade of Example 3B]

In the same operation as in the production of the cleaning blade of Example 1B, the steps from the start to the molding using the mold were conducted, a sheet-form polyurethane elastomer, 1.6 mm in thickness, was yielded. For a surface hardening treatment thereof, the sheet-form polyurethane elastomer was immersed in a 1.5% by weight solution of phenyl glycidyl ether acrylate hexamethylenediisocyanate urethane prepolymer (product name: AH-600, manufactured by Kyoeisha Chemical Co., Ltd.) in cyclohexane for 3 minutes, and then the surfaces were washed with cyclohexane. Thereafter, the blade portion was spot-cured with a UV-LED radiating device (product name: UV-400, manufactured by Keyence Co.) for 1 minute, and further post-cured at 90° C. for 3 hours.

The resultant sheet-form polyurethane elastomer was cut into a cleaning blade of Example 3B having a length of 12 mm and a width of 238 mm. A hot melt adhesive was used to stick the blade on a predetermined metal fitting, thereby yielding a cleaning blade unit of Example 3B.

[Production of a Cleaning Blade of Comparative Example 1B]

In the same operation as in the production of the cleaning blade of Example 1B, the steps from the start to the molding using the mold were conducted, a sheet-form polyurethane elastomer, 1.6 mm in thickness, was yielded.

This sheet-form polyurethane elastomer was post-cured at 105° C. for 6 hours, and further left at room temperature for 7 days. The resultant was not subject to the surface hardening treatment.

The sheet-form polyurethane elastomer allowed to be left was cut into a cleaning blade of Comparative Example 1B having a length of 12 mm and a width of 238 mm. A hot melt adhesive was used to stick the blade on a predetermined metal fitting, thereby yielding a cleaning blade unit of Comparative Example 1B.

[Production of a Cleaning Blade of Comparative Example 2B]

In the same operation as in the production of the cleaning blade of Example 1B, the steps from the start to the molding using the mold were conducted. The resultant sheet-form polyurethane elastomer, 1.6 mm in thickness, was masked with a tape so as to make a tip cleaning region of the elastomer exposed by 3 mm (about 40% of the length in the longitudinal direction). The resultant was immersed in MDI of 80° C. temperature for 30 minutes, and then the sheet-form polyurethane elastomer was pulled up. Extra MDI was wiped off with a cloth into which cyclohexane was impregnated, and then the masking was taken off.

Thereafter, in an oven of 130° C. temperature, the impregnated isocyanate compound was caused to react with the polyurethane resin for 60 minutes. Thereafter, the resultant was further left at room temperature for 7 days.

The sheet-form polyurethane elastomer allowed to be left was cut to leave the immersed portion of the sheet-form polyurethane elastomer, thereby forming a cleaning blade of Comparative Example 2B having a length of 12 mm and a width of 238 mm. A hot melt adhesive was used to stick the blade on a predetermined metal fitting, thereby yielding a cleaning blade unit of Comparative Example 2B.

[Production of a Cleaning Blade of Comparative Example 3B]

In the same operation as in the production of the cleaning blade of Example 1B, the steps from the start to the molding using the mold were conducted. The resultant sheet-form polyurethane elastomer, 1.6 mm in thickness, was masked with a tape so as to make a tip cleaning region of the elastomer exposed by 3 mm (about 40% of the length in the longitudinal direction). By plasma chemical vapor deposition, an evaporated layer of flexible diamond-like carbon (FDLC), 2 μm in thickness, was formed on long-side surfaces and a forward surface of the elastomer being base, which would form edges of the elastomer. In this way, a sheet-form polyurethane elastomer wherein the FDLC layer was formed on a portion abutting on a photosensitive member was yielded.

The sheet-form polyurethane elastomer was cut to leave the coated portion of the elastomer, thereby forming a cleaning blade of Comparative Example 3B having a length of 12 mm and a width of 238 mm. A hot melt adhesive was used to stick the blade on a predetermined metal fitting, thereby yielding a cleaning blade unit of Comparative Example 3B.

[Production of a Cleaning Blade of Comparative Example 4B]

In the same operation as in the production of the cleaning blade of Example 1B, the steps from the start to the molding using the mold were conducted. Regarding the resultant sheet-form polyurethane elastomer, 1.6 mm in thickness, a solution of butyl acrylate in 2,2-dimethoxy-1,2-diphenylethane-1-one (product name: IRGACURE 651, manufactured by Nagase & Co., Ltd.) (concentration: 3% by weight) was painted onto its blade surface for a surface hardening treatment thereof. The blade portion was spot-cured with a UV-LED radiating device (product name: UV-400, manufactured by Keyence Co.) for 1 minute, and further post-cured at 105° C. for 6 hours. Furthermore, the resultant was left at room temperature for 7 days.

The sheet-form polyurethane elastomer allowed to be left was cut into a cleaning blade of Comparative Example 4B having a length of 12 mm and a width of 238 mm. A hot melt adhesive was used to stick the blade on a predetermined metal fitting, thereby yielding a cleaning blade unit of Comparative Example 4A.

[Production of Toners]

(Toner of Examples 1B to 3B and Comparative Examples 1B to 3B)

(B-1. Preparation of a Colloidal Solution)

To an aqueous solution wherein 14.7 parts of magnesium chloride were dissolved in 250 parts of ion exchange water, an aqueous solution wherein 8.2 parts of sodium hydroxide were dissolved in 50 parts of ion exchange water were gradually added while stirring, so as to prepare a liquid dispersion of magnesium hydroxide colloid (6 parts of magnesium hydroxide) as a dispersion stabilizer.

(B-2. Polymerizable Monomer Composition)

The following were stirred and mixed to uniformly disperse by use of a bead mill: 83 parts of styrene; 17 parts of butyl acrylate; 5 parts of a magenta colorant (a solid solution of C.I. Pigment Red 31 and C.I. Pigment Red 150); 0.5 part of divinylbenzene; 2 parts of t-dodecylmercaptan; 2 parts of a charge control resin (styrene/n-butyl acrylate resin containing sulfonic acid groups; the ratio of a monomer containing a sulfonic acid group to all the monomers: 2% by weight); and 10 parts of dipentaerythritol hexamyristate. Thus, a polymerizable monomer composition was obtained.

(B-3. Aqueous Dispersion of a Polymerizable Monomer for Shell)

An ultrasonic emulsifying device was used to subject 2 parts of methyl methacrylate (Tg=105° C. according to calculation) and 100 parts of water to finely dispersing treatment, thereby yielding an aqueous dispersion of the monomer for shell. The particle diameter of droplets of the monomer for shell was measured with a particle diameter distribution measuring device (product name: SALD 2000A model, manufactured by Shimadzu Corp.). As a result, the D90 thereof was 1.6 μm.

(B-4. Production of Colored Polymer Particles)

The polymerizable monomer composition was charged into the magnesium hydroxide colloidal dispersion obtained as described above, and the resultant was stirred until droplets therein were stabilized. Thereto, 5 parts of t-butylperoxy-2-ethyl hexanoate (product name: PERBUTYL O, manufactured by NFO Corp.) as a polymerization initiator were added, and then an emulsifying/dispersing machine (product name: EBARA MILDER, manufactured by Ebara Corp.) was used to stir the resultant at a spinning rate of 15,000 rpm under the application of a high shearing force for 30 minutes, thereby forming droplets of the polymerizable monomer composition. This aqueous dispersion of the droplets of polymerizable monomer composition was charged into a reactor so as to conduct polymerization reaction at 90° C. When the polymerization conversion ratio reached substantially 100%, a sample was taken therefrom to measure the particle diameter of the colored particles (core). As a result, the volume average particle diameter was 6.3 μm.

The aqueous dispersion of the polymerizable monomer for shell and 0.3 part of a water-soluble initiator (product name: VA-086; 2,2'-azobis[2-methyl-N-(2-hydroxyethyl)-propioneamide], manufactured by Wako Pure Chemical Industries, Ltd.) were dissolved in 65 parts of distilled water, and the solution was charged into a reactor. Furthermore, the polymerization was continued for 8 hours, and then the reaction was stopped to yield an aqueous dispersion of colored particles having a pH of 9.5.

While the aqueous dispersion of the colored particles yielded as described above was stirred, the pH of the system was made into 5 or less with sulfuric acid. The system was washed with an acid (at 25° C. for 10 minutes), and then water was separated by filtration. Thereafter, thereto, newly 500 parts of ion exchange water were added to prepare a slurry again. The slurry was washed with water. Subsequently, dehydration and washing with water were again repeated several times to filtrate off a solid. In a drier, the solid was then dried at 45° C. for 2 days (48 hours) to yield dried colored particles. The volume average particle diameter of the colored particles was 6.4 μm.

(B-5. Preparation of a Toner)

To 100 parts of the colored particles obtained as described above, 0.5 part of silica having a number average particle diameter of 12 nm and treated for obtaining hydrophobicity and 2.2 parts of silica having a number average particle diameter of 40 nm were added, and then a Henschel mixer was used to mix these components with each other to prepare a nonmagnetic one-component toner.

(Toner of Comparative Example 4B)

A toner of Comparative Example 4B was produced in the same way as in the production of the toner of Examples 1B to 3B and Comparative Examples 1B to 3B except that in the item "B-4. Production of colored polymer particles", the emulsifying/dispersing machine (product name: EBARA MILDER, manufactured by Ebara Corp.) was changed to a high-speed stirring machine (product name: TK HOMO-MIXER, manufactured by Tokushu Kika Kogyo Co., Ltd.) to carry out forming droplets at a spinning rate of 3,000 rpm.

[Test Methods]

As for each of the cleaning blades, the following were measured: the Martens hardness (A) at 23° C. and an indenting load of 10 mN, the ratio (A)/(B) of the Martens hardness (A) at 23° C. and an indenting load of 10 mN to the Martens hardness (B) at 23° C. and an indenting load of 100 mN, and the loss tangent (tan δ) at 20 to 50° C.

(B-1. Measurement of the Martens Hardness (A) and (B))

The measurement was made in accordance with the procedure of an indenting test prescribed in ISO14577(10 sec. for 10 mN and 15 sec. for 100 mN). A used test device was a supermicro hardness tester (product name: FISCHERSCOPE 100C, manufactured by Fischer Instruments K.K.). A used indenter was a pyramidal diamond indenter having a square base and an opposing face angle of 136°.

The temperature in the test was set to 23° C., and the indenter was indented into the vicinity of a portion of the cleaning blade abutting on a photosensitive member (see FIG. 3. In the surface abutting on the photosensitive member, a region extending from the abutting corner thereof by a length of 4 mm in the longitudinal direction) at a constant speed. In this way, a load of 10 mN or 100 mN was applied thereto.

The Martens hardness of any test piece was measured using a square pyramidal diamond intender. The Martens hardness was calculated as a value obtained by applying a load (10 mN or 100 mN) to the cleaning blade and then dividing the load by the surface area of the intender penetrating so as to get over a contact zero point (see FIG. 5).

(B-2. Measurement of the Loss Tangent (tan δ) at 20 to 50° C.)

The loss tangent (tan δ) was calculated in the same way as in the item "A-2. Measurement of the loss tangent (tan δ) at 20 to 50° C.".

(B-3. Measurement of the Average Circularity)

The average circularity was obtained in the same way as in the item "A-3. Measurement of the average circularity and the particle diameter".

(B-4. Measurement of the Particle Diameter)

A particle diameter measuring device (product name: MULTISIZER, manufactured by Beckman Coulter GmbH) was used to measure the volume average particle diameter Dv, the number average particle diameter Dp, the particle diameter distribution Dv/Dp, the ratio of particles having a particle diameter of 4 μm or less (% by number) and the ratio of particles having a particle diameter of 16 μm or more of each of the toners. The measurement with the MULTISIZER was made under conditions that the aperture diameter was 100 μm, the solvent was ISOTON II, the concentration was 10% and the number of measured particles was 100,000.

Specifically, 5 to 20 mg of a sample of the toner was charged into a beaker, and then 0.1 to 1 mL of a surfactant, preferably alkylbenzenesulfonic acid was added thereto. Furthermore, 0.5 to 2 mL of ISOTON II was added to the beaker so as to swell the toner, and then 10 to 30 mL of ISOTON II was further added thereto. The toner was dispersed with an ultrasonic disperser for 1 to 3 minutes, and then the resultant was measured with the particle diameter measuring device.

(B-5. Measurement of the Absolute Value |Q/M| of the Charge Amount of Each of the Toners on the Photosensitive Member Surface)

Each of the cleaning blade units produced in Examples and Comparative Examples described above was set up to a commercially available nonmagnetic one-component printer (organic photosensitive developing drum, printing speed: 28 sheets per minute). To the printer, a cartridge filled with each of the toners allowed to be left in the NN environment for one day (24 hours) was mounted. Printing was then performed in the NN environment to make evaluation. The rotating speed of the photosensitive member surface at its point abutting on the cleaning blade (abutting portion) was set to 14 cm/sec.

First, white solid printing was made on a first sheet. Next, white solid printing was started on a second sheet and the printing was stopped in the middle way thereof. Thereafter, the absolute value |Q/M| (μC/g) of the charge amount of the toner adhering on the photosensitive member was measured with a suction type charge amount measuring device (product name: 210 HS-2A, manufactured by Trek Japan Corp.).

(B-6. Evaluation of the Reproducibility of Fine Lines)

Each of the toners prepared by the above-mentioned methods was left in the NN environment for one day, and then the printer used in the test B-5 was used to form line images continuously, using 2×2 dot lines (line width: about 85 μm). The printing was performed for 10,000 sheets. The rotating speed of the photosensitive member surface at its point abutting on the cleaning blade (abutting portion) was set to 14 cm/sec.

At intervals of 500 sheets out of the printed sheets, measurement was made using a print evaluating system (product name: RT 2000, manufactured by YA-MA Co.) to sample density distribution data of the line images. At this time, the overall width of the line image at the density giving a half of the largest value in the density distribution was used as a line width to be evaluated. The line width of the line images on the first sheet was used as a reference. When the difference between the reference and the line width to be evaluated was 10 μm or less, an evaluation that the line images on the first sheet were reproduced was made. In such a way, the number of the sheets on which the difference in line width between the line images was able to be kept at a value of 10 μm or less was examined.

(B-7. Evaluation of the Cleaning Performance)

Each of the toners prepared by the above-mentioned methods was left in the NN or LL environment for one day (24 hours), and then the printer used in the test B-5 was used to print halftone images having a print density of 5% continuously. The printing was performed for 10,000 sheets. The rotating speed of the photosensitive member surface at its point abutting on the cleaning blade (abutting portion) was set to 14 cm/sec.

At intervals of 500 sheets out of the printed sheets, the surface of the charging roller was visually observed. The number of the sheet printed when a matter that non-transferred toner which had passed over the cleaning blade adhered on the charging roller surface was recognized was defined as the number of the cleaning-defect-generated sheet.

(B-8. Evaluation of External Additive Filming)

Each of the toners prepared by the above-mentioned methods was left in the NN or LL environment for one day (24 hours), and then the printer used in the test B-5 was used to print halftone images in the same way as in the test B-7. The printing was made on 10,000 sheets.

At intervals of 500 sheets out of the printed sheets, light was radiated on the photosensitive member surface, and then the surface was visually observed. The number of the sheet printed when a matter that the external additive used as an external additive adhered on the photosensitive member surface was recognized was defined as the number of the external-additive-filming-generated sheet.

(B-9. Evaluation of Damage on the Photosensitive Member Surface)

Each of the toners prepared by the above-mentioned method was left in the NN or LL environment for one day (24 hours), and then the printer used in the test B-5 was used to print halftone images in the same way as in the test B-7. The printing was performed for 10,000 sheets.

At intervals of 500 sheets out of the printed sheets, the photosensitive member surface was visually observed. The number of the sheet printed when damage caused by the cleaning blade was recognized in the photosensitive member surface was defined as the number of the photosensitive-member-injure-generated sheet.

[Results]

The test results of the Example B series are shown in Tables 2-1 to 2-3.

Abbreviations in Tables 2-1 to 2-3 are as follows:

*1: abbreviations about monomers for binder resin, and polymerizable monomers for shell: ST (styrene), BA (butyl acrylate), DVB (divinylbenzene), MMA (methyl methacrylate)

TABLE 2-1

| | | Example 1B | Example 2B | Example 3B | Comparative Example 1B | Comparative Example 2B | Comparative Example 3B | Comparative Example 4B |
|---|---|---|---|---|---|---|---|---|
| Toner composition | Binder resin (ratio by weight in charged amounts) *1 | ST/BA/DVB (83/17/0.5) | Same as in Example 1B | Same as in Example 1B | Same as in Example 1B | Same as in Example 1B | Same as in Example 1B | Same as in Example 1B |
| | Magenta colorant | 5 parts | Same as in Example 1B | Same as in Example 1B | Same as in Example 1B | Same as in Example 1B | Same as in Example 1B | Same as in Example 1B |
| | Charge control agent | Charge control resin (2 parts) | Same as in Example 1B | Same as in Example 1B | Same as in Example 1B | Same as in Example 1B | Same as in Example 1B | Same as in Example 1B |
| | Monomer for shell | MMA (2 parts) | Same as in Example 1B | Same as in Example 1B | Same as in Example 1B | Same as in Example 1B | Same as in Example 1B | Same as in Example 1B |
| Cleaning blade | Base material | Polyurethane elastomer | Same as in Example 1B | Same as in Example 1B | Same as in Example 1B | Same as in Example 1B | Same as in Example 1B | Same as in Example 1B |
| | Constituting ingredient (polyol) | Polycaprolactone esterdiol | Polybutylene adipate diol | Same as in Example 1B | Same as in Example 1B | Same as in Example 1B | Same as in Example 1B | Same as in Example 1B |
| | Tan δ (maximum) | 0.03 | Same as in Example 1B | Same as in Example 1B | 0.06 | 0.03 | Same as in Com. Ex. 2B | Same as in Com. Ex. 2B |
| | Tan δ (minimum) | 0.02 | Same as in Example 1B | Same as in Example 1B | 0.03 | 0.02 | Same as in Com. Ex. 2B | Same as in Com. Ex. 2B |
| | 10 mN Martens hardness (A) ($N/mm^2$) | 0.79 | 0.85 | 0.93 | 0.73 | 0.83 | 1.62 | 0.54 |

TABLE 2-2

| | | Example 1B | Example 2B | Example 3B | Comparative Example 1B | Comparative Example 2B | Comparative Example 3B | Comparative Example 4B |
|---|---|---|---|---|---|---|---|---|
| Cleaning blade | 100 mN Martens hardness (A) ($N/mm^2$) | 0.56 | 0.68 | 0.59 | 0.37 | 0.77 | 0.61 | 0.41 |
| | (A)/(B) | 1.41 | 1.25 | 1.58 | 1.97 | 1.08 | 2.66 | 1.32 |
| | Rotating speed (cm/sec.) of photosensitive member at abutting portion | 14 | Same as in Example 1B | Same as in Example 1B | Same as in Example 1B | Same as in Example 1B | Same as in Example 1B | Same as in Example 1B |
| Toner physical properties | Average circularity | 0.978 | Same as in Example 1B | Same as in Example 1B | Same as in Example 1B | Same as in Example 1B | Same as in Example 1B | Same as in Example 1B |
| | Volume average particle diameter (μm) | 6.4 | Same as in Example 1B | Same as in Example 1B | Same as in Example 1B | Same as in Example 1B | Same as in Example 1B | 6.3 |

TABLE 2-2-continued

| | | Example 1B | Example 2B | Example 3B | Comparative Example 1B | Comparative Example 2B | Comparative Example 3B | Comparative Example 4B |
|---|---|---|---|---|---|---|---|---|
| | Ratio (% by number) particles 4 μm or less in diameter | 18 | Same as in Example 1B | Same as in Example 1B | Same as in Example 1B | Same as in Example 1B | Same as in Example 1B | 38 |

TABLE 2-3

| | | Example 1B | Example 2B | Example 3B | Comparative Example 1B | Comparative Example 2B | Comparative Example 3B | Comparative Example 4B |
|---|---|---|---|---|---|---|---|---|
| Toner physical properties | Ratio (% by volume) particles 16 μm or more in diameter | 0.05 | Same as in Example 1B | Same as in Example 1B | Same as in Example 1B | Same as in Example 1B | Same as in Example 1B | 1.30 |
| | \|Q/M\| (μC/g) | 35 | Same as in Example 1B | Same as in Example 1B | Same as in Example 1B | Same as in Example 1B | Same as in Example 1B | 45 |
| Evaluation results | Fine line reproducebility (NN) | 10,000 | 10,000 | 10,000 | 2,500 | 8,500 | 3,500 | 10,000 |
| | Cleaning property (NN) | 10,000 | 10,000 | 10,000 | 2,000 | 8,000 | 3,000 | 10,000 |
| | Cleaning property (LL) | 10,000 | 10,000 | 8,500 | 500 | 4,500 | 2,500 | 3,500 |
| | External additive filming (HH) | 10,000 | 9,000 | 10,000 | 1,500 | 4,500 | 10,000 | 10,000 |
| | External additive filming (LL) | 10,000 | 10,000 | 10,000 | 1,000 | 3,500 | 10,000 | 4,000 |
| | Damage on photo-sensitive member (NN) | 10,000 | 10,000 | 10,000 | 10,000 | 8,000 | 1,000 | 5,000 |

(Survey of Results)

In the Example B series, either one of the small-particle-diameter spherical toners was used to perform the continuous printing test, wherein high-speed continuous printing was performed. As a result, in Examples 1B to 3B, an excellent cleaning performance and an excellent fine line reproducibility were exhibited and neither external additive filming nor any damage in the photosensitive member surface was generated over a long term. On the other hand, in Comparative Examples 1B to 4B, a deterioration in the cleaning performance or the fine line reproducibility was recognized in the early stage, and the generation of external additive filming or damage in the photosensitive member surface was recognized.

Specifically, in Comparative Example 1B, the Martens hardness (A) of the cleaning blade at 23° C. and an indenting load of 10 mN was 0.73, which was in the range of 0.6 to 1.5 N/mm$^2$, but the value of the Martens hardness (B) at an indenting load of 100 mN was too small. Thus, the ratio (A)/(B) was 1.97, which was over the upper limit of the range of 1.1 to 1.8. As for the results of the durable printing test of Comparative Example 1B, the evaluation items of the cleaning performance in the environment of NN or LL, the fine line reproducibility in the environment of NN and the generation of external additive filming were poorer than those of the Examples. Particularly, It was characteristic that all of the evaluation items except damage on the photosensitive member surface were deteriorated in a quite early stage.

As for Comparative Example 2B, the Martens hardness (A) of the cleaning blade at 23° C. and an indenting load of 10 mN was 0.83, which was in the range of 0.6 to 1.5 N/mm$^2$, but the value of the Martens hardness (A) at an indenting load of 10 mN was far smaller than that of the Martens hardness (B) at an indenting load of 100 mN. Thus, the ratio (A)/(B) was 1.08, which was smaller than the lower limit of the range of 1.1 to 1.8. The cleaning blade used in Comparative Example 2B was similar to the cleaning blade disclosed in JP-A No. 2001-343874. As for the results of the continuous printing test of Comparative Example 2B, the evaluation items of the cleaning performance in the LL or NN environment and the fine line reproducibility in the NN environment were poorer than those of Examples 1B to 3B. The generation of external additive filming in the environment of HH or LL, or damage in the photosensitive member surface under the NN condition was also recognized.

As for Comparative Example 3B, the Martens hardness (A) of the cleaning blade at 23° C. and an indenting load of 10 mN was 1.62, which was larger than the upper limit of the range of 0.6 to 1.5 N/mm$^2$. The ratio (A)/(B) was 2.6, which was far larger than the upper limit of the range of 1.1 to 1.8. The cleaning blade used in Comparative Example 3B was similar to the cleaning blade disclosed in JP-A No. 2003-103686.

Regarding the results of the continuous printing test of Comparative Example 3B, the generation of external additive filming was not observed in the environment of HH or LL, however, the evaluation items of the cleaning performance in the environment of LL or NN, and the fine line reproducibility in the environment of NN were poorer than those in Examples 1B to 3B. Furthermore, damage was observed in the photosensitive member surface in a quite early stage.

As for Comparative Example 4B, the Martens hardness (A) of the cleaning blade at 23° C. and an indenting load of 10 mN was 0.54, which was smaller than the lower limit of the range of 0.6 to 1.5 N/mm$^2$. The ratio (A)/(B) was 1.32, which was over the upper limit of the range of 1.1 to 1.8. As for the results of the continuous printing test of Comparative Example 4B, deterioration in the fine line reproducibility in the environment of NN and that in the cleaning performance in the environment of NN were not recognized, and external additive filming was not caused in the environment of HH, either. However, the cleaning performance was deteriorated at an early stage in the environment of LL. The generation of external additive filming in the environment of LL, and damage on the photosensitive member surface in the environment of NN were recognized.

What is claimed is:

1. A method of forming an image comprising processes of:

a developing process to form a visible image on a photosensitive member by a toner comprising colored particles containing a binder resin and a colorant;

a transferring process to transfer the visible image onto a recording material so as to form a transferred image;

a fixing process to fix the transferred image; and a cleaning process to remove the toner remaining on the photosensitive member after the transfer by a cleaning blade abutting on the photosensitive means, wherein the colored particles have an average circularity of 0.95 to 0.998 and an abutting portion of the cleaning blade on the photosensitive member has an indentation modulus (A) of 5 to 15 KPa at an indenting load of 10 mN and 23° C., a ratio of the modulus (A) to an indentation modulus (B) at an indenting load of 100 mN and 23° C. of 1.1 to 1.8, and a loss tangent (tan δ) of the cleaning blade at 20 to 50° C. in the range from 0.01 to 0.1.

2. The method of forming an image according to claim 1, wherein the cleaning blade is formed of polyurethane obtained by a reaction of polyesterpolyol and polyisocyanate.

3. The method of forming an image according to claim 1, wherein the volume average particle diameter of the colored particles is in the range from 4 to 8 μm, the ratio of the colored particles having a particle diameter of 4 μm or less is 30% or less by number, and the ratio of the colored particles having a particles diameter of 16 μm or more is 1% or less by volume.

4. The method of forming an image according to claim 1, wherein a surface of the cleaning blade is subject to a hardening treatment.

5. The method of forming an image according to claim 1, wherein the absolute value |Q/M| of the charge amount of the toner on the surface of the photosensitive member is in the range from 10 to 80 μC/g.

6. The method of forming an image according to claim 1, wherein in the cleaning process, the rotating speed of the photosensitive member at the abutting portion of the cleaning blade on the photosensitive member is 10 cm/sec. or more.

7. The method of forming an image according to claim 1, wherein the abutting portion of the cleaning blade on the photosensitive member has a Martens hardness (A) of 0.6 to 1.5 N/mm$^2$ at an indenting load of 10 mN and 23° C. and a ratio of the hardness (A) to a Martens hardness (B) at an indenting load of 100 mN and 23° C. of 1.1 to 1.8.

8. The method of forming an image according to claim 7, wherein the absolute value |Q/M| of the charge amount of the toner on the surface of the photosensitive member after the developing process and before the transferring process is in the range from 10 to 70 μC/g.

9. The method of forming an image according to claim 7, wherein in the cleaning process, the rotating speed of the photosensitive member at the abutting portion of the cleaning blade on the photosensitive member is 12 cm/sec. or more.

* * * * *